US008630849B2

(12) United States Patent
Son et al.

(10) Patent No.: US 8,630,849 B2
(45) Date of Patent: Jan. 14, 2014

(54) COEFFICIENT SPLITTING STRUCTURE FOR VECTOR QUANTIZATION BIT ALLOCATION AND DEQUANTIZATION

(75) Inventors: Chang-Yong Son, Gunpo-si (KR); Eun-Mi Oh, Seongnam-si (KR); Ho-Sang Sung, Yongin-si (KR); Kang-Eun Lee, Gangneung-si (KR); Ki-Hyun Choo, Seoul (KR); Jung-Hoe Kim, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1286 days.

(21) Appl. No.: 11/911,775

(22) PCT Filed: Nov. 15, 2006

(86) PCT No.: PCT/KR2006/004803

§ 371 (c)(1),
(2), (4) Date: Oct. 17, 2007

(87) PCT Pub. No.: WO2007/058465

PCT Pub. Date: May 24, 2007

(65) Prior Publication Data

US 2008/0183465 A1 Jul. 31, 2008

Related U.S. Application Data

(60) Provisional application No. 60/736,315, filed on Nov. 15, 2005.

(30) Foreign Application Priority Data

Apr. 12, 2006 (KR) ..... 10-2006-0033211

(51) Int. Cl.
*G10L 19/12* (2013.01)
*G10L 21/00* (2013.01)

(52) U.S. Cl.
USPC ..... 704/222; 704/223; 704/230

(58) Field of Classification Search
None
See application file for complete search history.

(56) References Cited

U.S. PATENT DOCUMENTS 5,596,676 A * 1/1997 Swaminathan et al. ..... 704/208
5,651,026 A * 7/1997 Lin et al. ..... 375/240

(Continued)

FOREIGN PATENT DOCUMENTS

KR 100322706 1/2002

OTHER PUBLICATIONS

Xie et al. "Algebraic Vector Quantization of LSF Parameters with Low Storage and Computational Complexity". IEEE Transactions on Speech and Audio Processing, vol. 4, No. 3, May 1996, p. 234-239.*

(Continued)

*Primary Examiner* — Jesse Pullias
(74) *Attorney, Agent, or Firm* — Stanzione & Kim LLP

(57) ABSTRACT

A method and apparatus to convert a linear predictive coding (LPC) coefficient into a coefficient having order characteristics, such as a line spectrum frequency (LSF), and to vector quantize the coefficient having the order characteristics when a speech signal is encoded. The method and apparatus split the vector of the coefficient having the order characteristics into a plurality of subvectors, select a codebook in which an available bit is variably allocated to each subvector according to distribution of elements of each subvector, and quantize each subvector according to the selected codebook. The method and apparatus use normalized codebooks.

71 Claims, 12 Drawing Sheets

(56) References Cited

U.S. PATENT DOCUMENTS

| | | | | |
|---|---|---|---|---|
| 5,822,723 | A | 10/1998 | Kim et al. | |
| 6,199,037 | B1 * | 3/2001 | Hardwick | 704/208 |
| 6,253,173 | B1 * | 6/2001 | Ma | 704/222 |
| 6,269,333 | B1 | 7/2001 | Ravishankar | |
| 6,615,174 | B1 | 9/2003 | Arslan et al. | |
| 6,622,120 | B1 * | 9/2003 | Yoon et al. | 704/222 |
| 6,704,705 | B1 * | 3/2004 | Kabal et al. | 704/230 |

OTHER PUBLICATIONS

European Search Report issued Feb. 24, 2011 in EP Application No. 06812616.8.

Woo-Jin Han et al: "Multicodebook Split Vector Quantization of LSF Parameters", IEEE Signal Processing Letters, IEEE, Service Center, Piscataway, NJ, US, vol. 9, No. 12, Dec. 1, 2002, XP011067866, ISSN: 1070-9908 *paragraph [0011]* .

Korean Office Action Issued on May 24, 2012 in KR Patent Application No. 10-2006-0113045.

Korean Final Rejection issued on Jan. 31, 2013 in KR Patent Application No. 10-2006-0113045.

Korean Office Action dated May 27, 2013 issued in KR Patent Application No. 10-2006-0113045.

International Search Report dated Feb. 21, 2007 issued in PCT/KR2006/004803.

* cited by examiner

COEFFICIENT SPLITTING STRUCTURE FOR VECTOR QUANTIZATION BIT ALLOCATION AND DEQUANTIZATION

CROSS-REFERENCE TO RELATED APPLICATIONS

This application claims priority under 35 U.S.C. §119 from U.S. Provisional Patent Application No. 60/736,315, filed on Nov. 15, 2005, and priority under 35 U.S.C. §119(a) from Korean Patent Application No. 10-2006-0033211, filed on Apr. 12, 2006, in the Korean Intellectual Property Office, the disclosures of which are incorporated herein in their entirety by reference.

BACKGROUND OF THE INVENTION

1. Field of the Invention

The present general inventive concept relates to encoding and decoding a speech signal, and more particularly, to a method and apparatus to convert a linear predictive coding (LPC) coefficient into a coefficient having order characteristics, such as a line spectrum frequency (LSF), and vector-quantizing the coefficient having the order characteristics.

2. Description of the Related Art

Methods of quantization of prediction error of LSF coefficients can be divided into two types, scalar quantization methods and vector quantization methods. The scalar quantization method quantizes an input signal into a discrete values, and the vector quantization method determines an input signal as a sequence of several related signals and uses a vector as a basic unit of quantization. At present, the vector quantization method is more widely used than the scalar quantization method. Although the vector quantization method uses more bits, it provides better performance as compared to the scalar quantization method.

For high quality speech coding in a speech coding system, it is very important to efficiently quantize linear predictive coding (LPC) coefficients indicating a short interval correlation of a speech signal. In an LPC filter, an optimal LPC coefficient value is obtained so that after an input voice signal is divided into frame units, the energy of a prediction error for each frame is minimized. So far, many methods for efficient quantization of LPC coefficients have been developed and are actually being used in voice compression apparatuses. One of these methods, direct quantization of LPC filter coefficients, has problems in that the characteristic of an LPC filter is too sensitive to quantization errors of LPC coefficients, and stability of the LPC filter after quantization is not guaranteed. Accordingly, LPC coefficients should be converted into other parameters having a good quantization characteristic and then quantized, i.e., reflection coefficients or line spectrum frequency (LSF) coefficients. Moreover, most standard speech coders recently developed utilize the LSF quantization speech coding method since the LSF coefficients are closely associated with speech signal frequency properties of speech signals.

When a speech signal is coded, the speech signal is usually converted into line spectrum frequency (LSF) coefficients, and the LSF coefficients are then quantized. This is because significant changes occur when linear predictive coding (LPC) coefficients themselves are quantized using a small number of bits. Since each LSF coefficient is discretely quantized in the scalar quantization method, at least 32 bits/frames are required to express high speech quality. However, most speech coders operating at 4.8 Kbps do not assign more than 24 bits/frame to each LSF coefficient. Therefore, the vector quantization method is used to reduce the number of bits used.

The vector quantization method achieves effective data compression by creating data as a block and quantizing the data in units of vectors. The vector quantization method is used in a wide range of areas such as image processing, speech processing, facsimile transmission, and meteorological satellites communications. Codebooks indicating data vectors are very important to encode and decode data using the vector quantization method.

It is difficult for such codebooks used in the vector quantization method to provide optimal quantization for LSF coefficients having diverse ranges. In addition, when LSF coefficients in the same range have different average values, quantization efficiency is reduced. Therefore, a more effective way of quantizing and de-quantizing LPC coefficients is needed.

SUMMARY OF THE INVENTION

The present general inventive concept provides a method and apparatus to split a vector of a coefficient having order characteristics, and which was converted from a linear predictive coding (LPC) coefficient, into a plurality of subvectors, to select a codebook in which an available bit is variably allocated to each subvector according to a distribution of elements of each subvector, and to quantize each subvector according to the selected codebook.

The present general inventive concept also provides a method and apparatus to de-quantize an LPC coefficient into a line spectrum frequency (LSF) using a codebook index generated after an encoder converts the LPC coefficient into a vector of a coefficient having order characteristics, splits the vector of the coefficient into an upper subvector and lower subvectors, and quantizes the upper subvector and the lower subvectors.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a method of converting a linear predictive coding (LPC) coefficient into a coefficient having order characteristics and quantizing the coefficient, the method including: splitting a vector of the coefficient having the order characteristics into a plurality of subvectors, selecting a codebook in which an available bit is allocated to each of the plurality of subvectors according to a distribution of elements of each of the plurality of subvectors, and quantizing each of the plurality of subvectors using the selected codebook and generating a codebook index of each of the plurality of subvectors.

The foregoing and/or other aspects of the present general inventive concept may also be achieved by providing a method of de-quantizing an LPC coefficient into an LSF using a codebook index generated after an encoder converts the LPC coefficient into a vector of a coefficient having order characteristics, splits the vector of the coefficient into an upper subvector and lower subvectors, and quantizes the upper subvector and the lower subvectors, the method including de-quantizing the upper subvector using a codebook index of the upper subvector, selecting a codebook using elements of the de-quantized upper subvector, de-quantizing each of the lower subvectors using a codebook index of each of the lower subvectors included in the selected codebook, and generating an LSF vector using the de-quantized upper subvector and the lower subvectors.

The foregoing and/or other aspects of the present general inventive concept may also be achieved by providing a method of generating a codebook, the method including splitting a vector of a coefficient having order characteristics which was converted from an LPC coefficient, into an upper subvector including anchor elements among elements that constitute the vector of the coefficient having the order characteristics and lower subvectors, each including elements respectively interposed between the elements of the upper subvector, classifying each of the lower subvectors by allocating an available bit to each of the lower subvectors using the upper subvector, and generating a codebook by training the upper subvector and each of the classified lower subvectors.

The foregoing and/or other aspects of the present general inventive concept may also be achieved by providing a method of quantizing a linear predictive coding (LPC) coefficient, including converting an LPC coefficient into a coefficient having a vector, splitting the vector into an upper subvector and plural lower subvectors, quantizing the upper subvector to generate upper subvector codebook indices, selecting a codebook for use with the lower subvectors from a codebook storage unit based on the upper subvector codebook indices, quantizing the plural lower subvectors using the selected codebook, selecting a codebook index having a smallest distortion from the upper subvector codebook indices including allocating available bits in a codebook to each of the plural lower subvectors according to a predetermined value, generating a codebook index for the upper subvector and each of the plural lower subvectors as a bitstream, and transmitting the bitstream.

The foregoing and/or other aspects of the present general inventive concept may also be achieved by providing a computer-readable medium having embodied thereon a computer program to execute a method of converting a linear predictive coding (LPC) coefficient into a coefficient having order characteristics and quantizing the coefficient, the method including splitting a vector of the coefficient having the order characteristics into a plurality of subvectors, selecting a codebook in which an available bit is allocated to each of the subvectors according to distribution of elements of each of the subvectors, and quantizing each of the subvectors using the selected codebook and generating a codebook index of each of the subvectors.

The foregoing and/or other aspects of the present general inventive concept may also be achieved by providing a computer-readable medium having embodied thereon a computer program to execute a method of de-quantizing an LPC coefficient into an LSF using a codebook index generated after an encoder converts the LPC coefficient into a vector of a coefficient having order characteristics, splits the vector of the coefficient into an upper subvector and lower subvectors, and quantizes the upper and lower subvectors, the method including de-quantizing the upper subvector using a codebook index of the upper subvector, selecting a codebook using elements of the de-quantized upper subvector, de-quantizing each of the lower subvectors using a codebook index of each of the lower subvectors included in the selected codebook, and generating an LSF vector using the de-quantized upper subvector and the de-quantized lower subvectors.

The foregoing and/or other aspects of the present general inventive concept may also be achieved by providing a computer-readable medium having embodied thereon a computer program to execute a method of generating a codebook, the method including splitting a vector of a coefficient having order characteristics, which was converted from an LPC coefficient, into an upper subvector comprised of anchor elements among elements that constitute the vector of the coefficient having the order characteristics and lower subvectors, each comprised of elements respectively interposed between the elements of the upper subvector, classifying each of the lower subvectors by allocating an available bit to each of the lower subvectors using the upper subvector, and generating a codebook by training the upper subvector and each of the classified subvectors.

The foregoing and/or other aspects of the present general inventive concept may also be achieved by providing a computer-readable medium having embodied thereon a computer program to execute a method of quantizing a linear predictive coding (LPC) coefficient, including converting an LPC coefficient into a coefficient having a vector, splitting the vector into an upper subvector and plural lower subvectors, quantizing the upper subvector to generate upper subvector codebook indices, selecting a codebook for use with the lower subvectors from a codebook storage unit based on the upper subvector codebook indices, quantizing the plural lower subvectors using the selected codebook, selecting a codebook index having a smallest distortion from the upper subvector codebook indices including allocating available bits in a codebook to each of the plural lower subvectors according to a predetermined value, generating a codebook index for the upper subvector and each of the plural lower subvectors as a bitstream, and transmitting the bitstream.

The foregoing and/or other aspects of the present general inventive concept may also be achieved by providing an apparatus to convert an LPC coefficient into a coefficient having order characteristics and to quantize the coefficient, the apparatus including a vector split unit to split a vector of the coefficient having the order characteristics into a plurality of subvectors, a codebook storage unit to store codebooks in which an available bit is allocated to each of the subvectors according to distribution of elements of each of the subvectors that constitute the vector of the coefficient having the order characteristics, a codebook selection unit to select a codebook from the codebooks stored in the codebook storage unit according to the distribution of the elements of each of the subvectors, and a quantization unit to quantize each of the subvectors using the selected codebook and to generate a codebook index of each of the subvectors.

The foregoing and/or other aspects of the present general inventive concept may also be achieved by providing an apparatus to de-quantize an LPC coefficient into an LSF using a codebook index generated after an encoder converts the LPC coefficient into a vector of a coefficient having order characteristics, splits the vector of the coefficient into an upper subvector and lower subvectors, and quantizes the upper subvector and the lower subvectors, the apparatus including a first de-quantization unit to de-quantize the upper subvector using a codebook index of the upper subvector, a codebook storage unit to store codebooks in which an available bit is allocated to each of the subvectors according to distribution of elements of each of the subvectors that constitute the vector of the coefficient having the order characteristics, a codebook selection unit to select a codebook from the codebooks stored in the codebook storage unit using elements of the de-quantized upper subvector, a second de-quantization unit to de-quantize each of the lower subvectors using a codebook index of each of the lower subvectors included in the selected codebook, and a coefficient generation unit to generate an LSF vector using the de-quantized upper subvector and the lower subvectors.

The foregoing and/or other aspects of the present general inventive concept may also be achieved by providing an apparatus to generate a codebook including a vector split unit to split a vector of a coefficient having order characteristics, which was converted from an LPC coefficient, into an upper subvector including anchor elements among elements that constitute the vector of the coefficient having the order characteristics and lower subvectors, each including elements respectively interposed between the elements of the upper subvector, a vector classification unit to classify each of the lower subvectors by allocating an available bit to each of the lower subvectors using the upper subvector, and a codebook generation unit to generate a codebook by training the upper subvector and each of the classified subvectors.

The foregoing and/or other aspects of the present general inventive concept may also be achieved by providing an apparatus to convert an LPC coefficient into a predetermined coefficient and to quantize the coefficient, the apparatus including a vector split unit to split a vector of the predetermined coefficient into subvectors, a codebook storage unit to store codebooks in which an available bit is allocated to each of the subvectors according to a distribution of elements of each of the subvectors, a codebook selection unit to select a codebook from the codebooks stored in the codebook storage unit according to the distribution of the elements of each of the subvectors, and a quantization unit to quantize each of the subvectors using the selected codebook and to generate a codebook index of each of the subvectors.

The foregoing and/or other aspects of the present general inventive concept may also be achieved by providing an apparatus to generate a codebook, the apparatus including a vector split unit to split a vector of a predetermined coefficient into an upper subvector and plural lower subvectors, each subvector comprised of elements, a vector classification unit to classify each of the lower subvectors using the elements of the upper subvector, and a codebook generation unit to generate a codebook by training the upper subvector and each of the classified subvectors using an LGB algorithm.

According to another aspect of the present invention, there is provided a method of converting an LPC coefficient into a coefficient having order characteristics and quantizing the coefficient, the method including splitting a vector of the coefficient having the order characteristics into an upper subvector and lower subvectors; quantizing the upper subvector; selecting a codebook in which an available bit is allocated to each of the lower subvectors according to distribution of elements of the quantized upper subvector; normalizing elements of the lower subvectors; and quantizing each of the lower subvectors using the selected codebook and generating a codebook index of each of the lower subvectors, wherein the codebook is normalized.

According to another aspect of the present invention, there is provided a method of de-quantizing an LPC coefficient into an LSF using a codebook index generated after an encoder converts the LPC coefficient into a vector of a coefficient having order characteristics, splits the vector of the coefficient into an upper subvector and lower subvectors, and quantizes the upper and lower subvectors, the method including de-quantizing the upper subvector using a codebook index of the upper subvector; selecting a normalized and pre-stored codebook using elements of the de-quantized upper subvector; de-quantizing each of the lower subvectors using a codebook index of each of the lower subvectors included in the selected codebook; de-normalizing each of the de-quantized lower subvectors; and generating an LSF vector using the de-quantized upper subvector and the de-normalized lower subvectors.

According to another aspect of the present invention, there is provided an apparatus for converting an LPC coefficient into a coefficient having order characteristics and quantizing the coefficient, the apparatus including a vector split unit splitting a vector of the coefficient having the order characteristics into an upper subvector and lower subvectors; a first quantization unit quantizing the upper subvector; a codebook storage unit storing codebooks in which an available bit is allocated to each of the lower subvectors according to distribution of elements of the quantized upper subvector; a codebook selection unit selecting a codebook from the codebook storage unit according to the distribution of the elements of the upper subvector; a normalization unit normalizing elements of the lower subvectors; and a second quantization unit quantizing each of the lower subvectors using the selected codebook and generating a codebook index of each of the lower subvectors, wherein the codebooks are normalized.

According to anther aspect of the present invention, there is provided an apparatus for de-quantizing an LPC coefficient into an LSF using a codebook index generated after an encoder converts the LPC coefficient into a vector of a coefficient having order characteristics, splits the vector of the coefficient into an upper subvector and lower subvectors, and quantizes the upper and lower subvectors, the apparatus including a first de-quantization unit de-quantizing the upper subvector using a codebook index of the upper subvector; a codebook storage unit storing codebooks in which an available bit is allocated to each of the subvectors according to distribution of elements of each of the subvectors that constitute the vector of the coefficient having the order characteristics; a codebook selection unit selecting a codebook from the codebook storage unit using elements of the de-quantized upper subvector; a second de-quantization unit de-quantizing each of the lower subvectors using a codebook index of each of the lower subvectors included in the selected codebook; a de-normalization unit de-normalizing each of the de-quantized lower subvectors; and a coefficient generation unit generating an LSF vector using the de-quantized upper subvector and the de-normalized lower subvectors, wherein the codebook is normalized.

According to another aspect of the present invention, there is provided a computer-readable recording medium on which a program for executing a method is recorded, the method including splitting a vector of a coefficient having order characteristics, which was converted from an LPC coefficient, into an upper subvector and lower subvectors; quantizing the upper subvector; selecting a normalized codebook in which an available bit is allocated to each of the lower subvectors according to distribution of elements of the quantized upper subvector; normalizing elements of the lower subvectors; and quantizing each of the lower subvectors using the selected codebook and generating a codebook index of each of the lower subvectors.

According to another aspect of the present invention, there is provided a computer-readable recording medium on which a program for executing a method is recorded, the method including de-quantizing an upper subvector using a codebook index of the upper subvector in a bitstream generated after an encoder converts an LPC coefficient into a vector of a coefficient having order characteristics, splits the vector of the coefficient into the upper subvector and lower subvectors, and quantizes the upper and lower subvectors; selecting a normalized and pre-stored codebook using elements of the de-quantized upper subvector; de-quantizing each of the lower subvectors using a codebook index of each of the lower subvectors included in the selected codebook; de-normalizing each of the de-quantized lower subvectors; and generating an LSF vector using the de-quantized upper subvector and the de-normalized lower subvectors.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
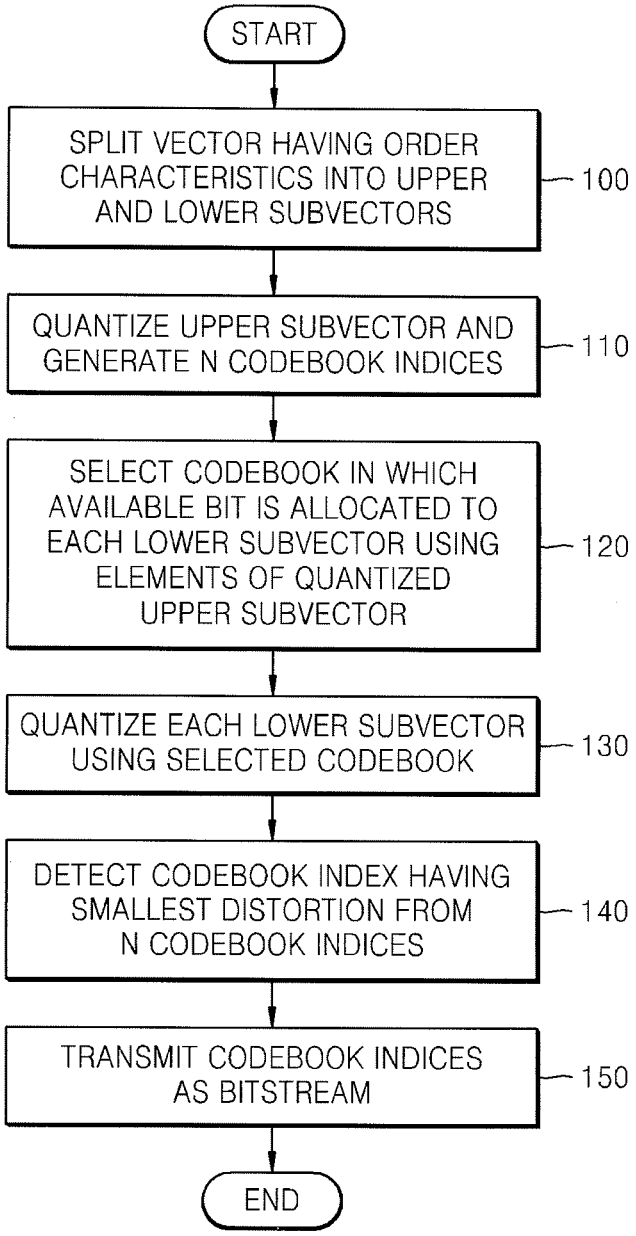
FIG. 1 is a flowchart illustrating a method of quantizing a linear predictive coding (LPC) coefficient according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a flowchart illustrating a method of quantizing a linear predictive coding (LPC) coefficient according to an embodiment of the present general inventive concept. FIGS. 7 through 11 conceptually illustrate the method of FIG. 1. The method of quantizing an LPC coefficient according to the present embodiment will now be described with reference to FIGS. 7 through 11.

A vector of a coefficient having order characteristics, which was converted from an LPC coefficient, is split into an upper subvector and lower subvectors (operation 100). Here, the coefficient having order characteristics may be any one of a line spectrum frequency (LSF), a line spectral pair (LSP), immittance spectral frequencies (ISFs) and an immittance spectral pair (ISP). The upper subvector obtained after the vector of the coefficient having order characteristics is split in operation 100 is composed of anchor elements among elements that constitute the vector of the coefficient having order characteristics. Each of the lower subvectors is composed of elements respectively interposed between the elements of the upper subvector, among the elements that constitute the vector of the coefficient having order characteristics.

Figure 7:
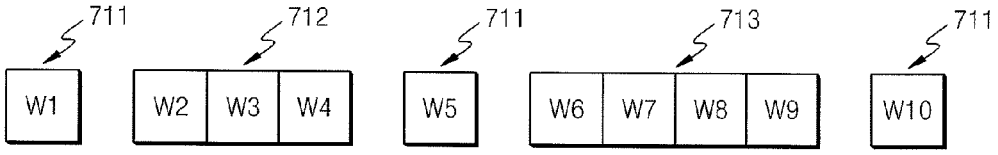
FIG. 7 is a conceptual diagram illustrating an upper subvector obtained after a vector of a coefficient having order characteristics is split according to an embodiment of the present general inventive concept.

Referring to FIG. 7, the upper subvector corresponds to a first subvector 711, and the lower subvectors correspond to second and third subvectors 712 and 713. In this case, the first subvector 711 is composed of elements w1, w5 and w10. The second subvector 712 interposed between elements w1 and w5 is composed of elements w2, w3 and w4, and the third subvector 713 interposed between elements w5 and w10 is composed of elements w6, w7, w8 and w9.

The upper subvector obtained after the vector of the coefficient having order characteristics is split in operation 100 is vector-quantized into a codebook index (operation 110). In other words, the first subvector 711 is quantized into a first codebook index.

In operation 110, N codebook indices, not just one codebook index, may be generated for the upper subvector to obtain an optimal combination of vectors of the coefficient having order characteristics.

A codebook, in which an available bit is allocated to each lower subvector using the elements of the upper subvector quantized in operation 110 and according to distribution of the elements of each lower subvector, is selected (operation 120). In other words, a distribution of the elements of the second and third subvectors 712 and 713 is determined using elements w1, w5 and w10 of the first subvector 711. Then, codebooks, in which available bits are allocated to the second and third subvectors 712 and 713, respectively, are selected.

The operation of selecting a codebook using the elements of the upper subvector in operation 120 may be performed according to the following exemplary embodiments of the present general inventive concept.

Figure 8:
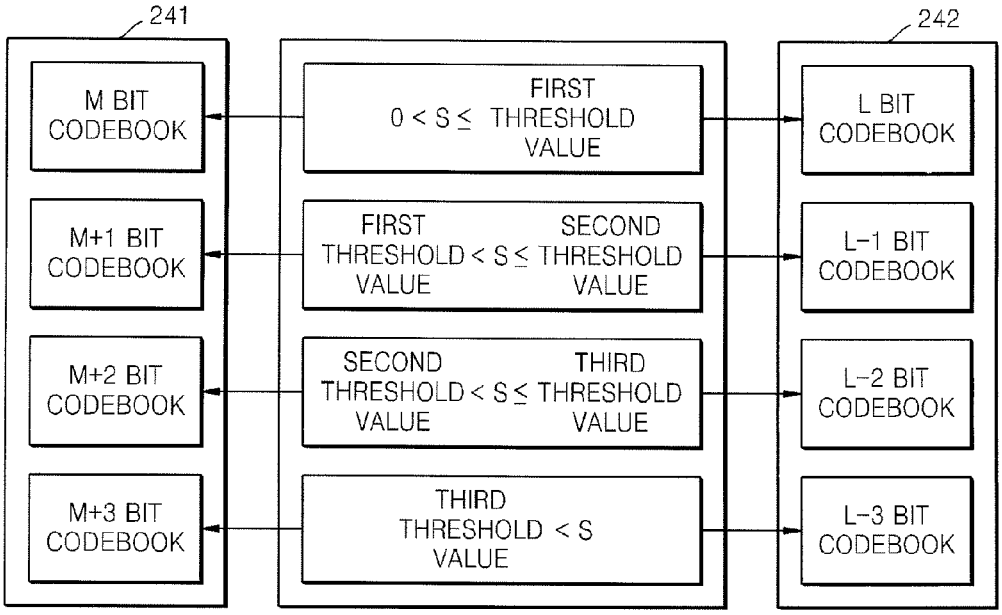
FIG. 8 is a conceptual diagram illustrating a method of classifying codebooks according to an embodiment of the present general inventive concept.

According to an embodiment of the present general inventive concept, a codebook, in which an available bit is allocated to each lower subvector according to a ratio of intervals between the elements of the upper subvector quantized in operation 110, is selected. In FIG. 8, reference character s indicates a ratio of intervals between the elements of the upper subvector, which corresponds to a value of (w5−w1)/(w10−w5) in FIG. 7. As an interval between w1 and w5 increases versus an interval between elements w5 and w10, a number of bits allocated to the second subvector 712 between elements w1 and w5 is gradually increased. Therefore, a number of bits allocated to a codebook is increased from M bits to (M+3) bits. Conversely, as a number of bits allocated to the third subvector 713 between elements w5 and w10 is gradually reduced, a number of bits allocated to a codebook is reduced from L bits to (L−3) bits.

Figure 9:
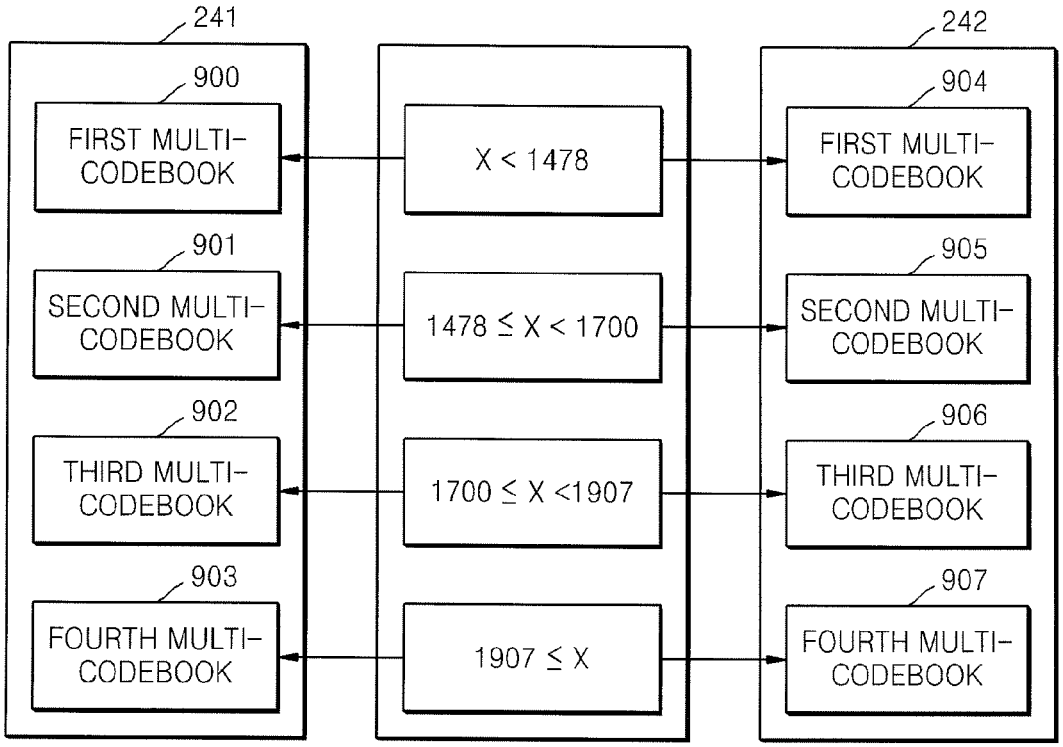
FIG. 9 is a conceptual diagram illustrating a method of classifying codebooks according to another embodiment of the present general inventive concept.

According to another embodiment of the present general inventive concept, a codebook, in which an available bit is allocated to each lower subvector according to an existence range of a predetermined quantized element among the elements of the quantized upper subvector, is selected. An anchor element, which greatly affects a distribution of the elements of each lower subvector, is selected from the elements of the upper subvector and preset as a predetermined quantized element. Referring to FIG. 9, when it is assumed that x denotes w5, a codebook, in which an available bit is allocated to each lower subvector according to an existence range of w5, is selected. In this case, x is the anchor element which is selected to be the predetermined quantized element.

The codebook selected in operation 120 is stored using the following methods.

Figure 10:
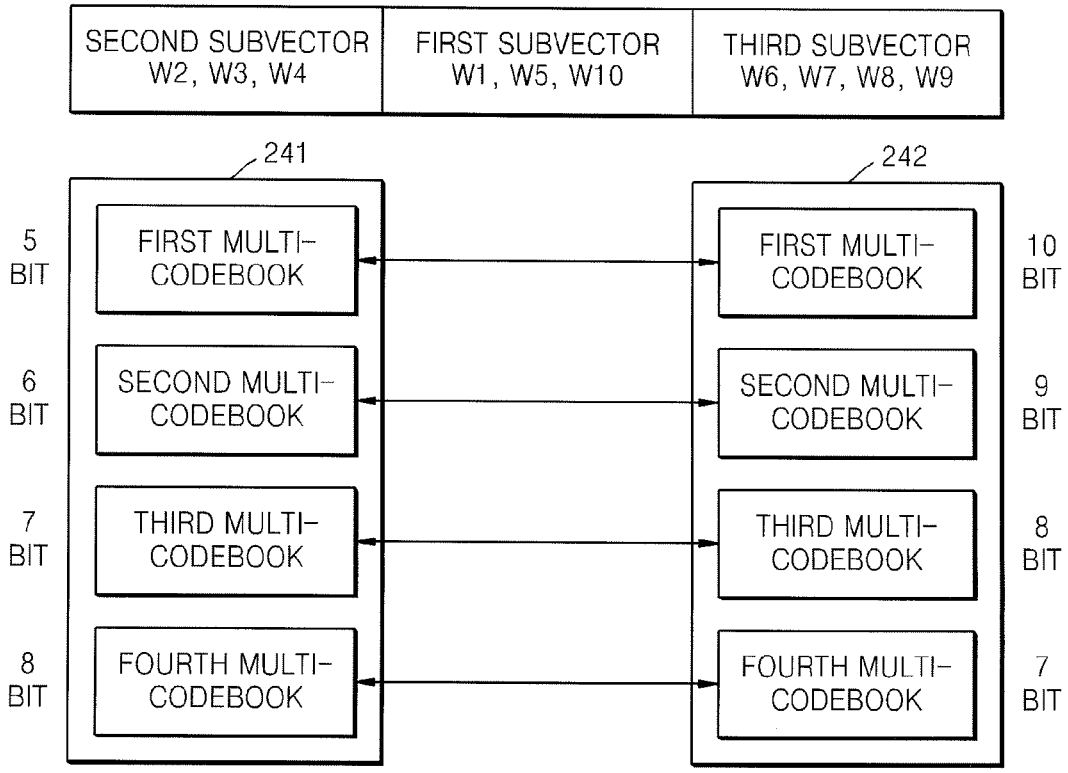
FIG. 10 is a conceptual diagram illustrating a method of storing codebooks according to an embodiment of the present general inventive concept.

First, a plurality of multi-codebooks storing various codebooks according to an available bit allocated to each lower subvector may be configured as illustrated in FIG. 10 and stored accordingly.

Figure 11:
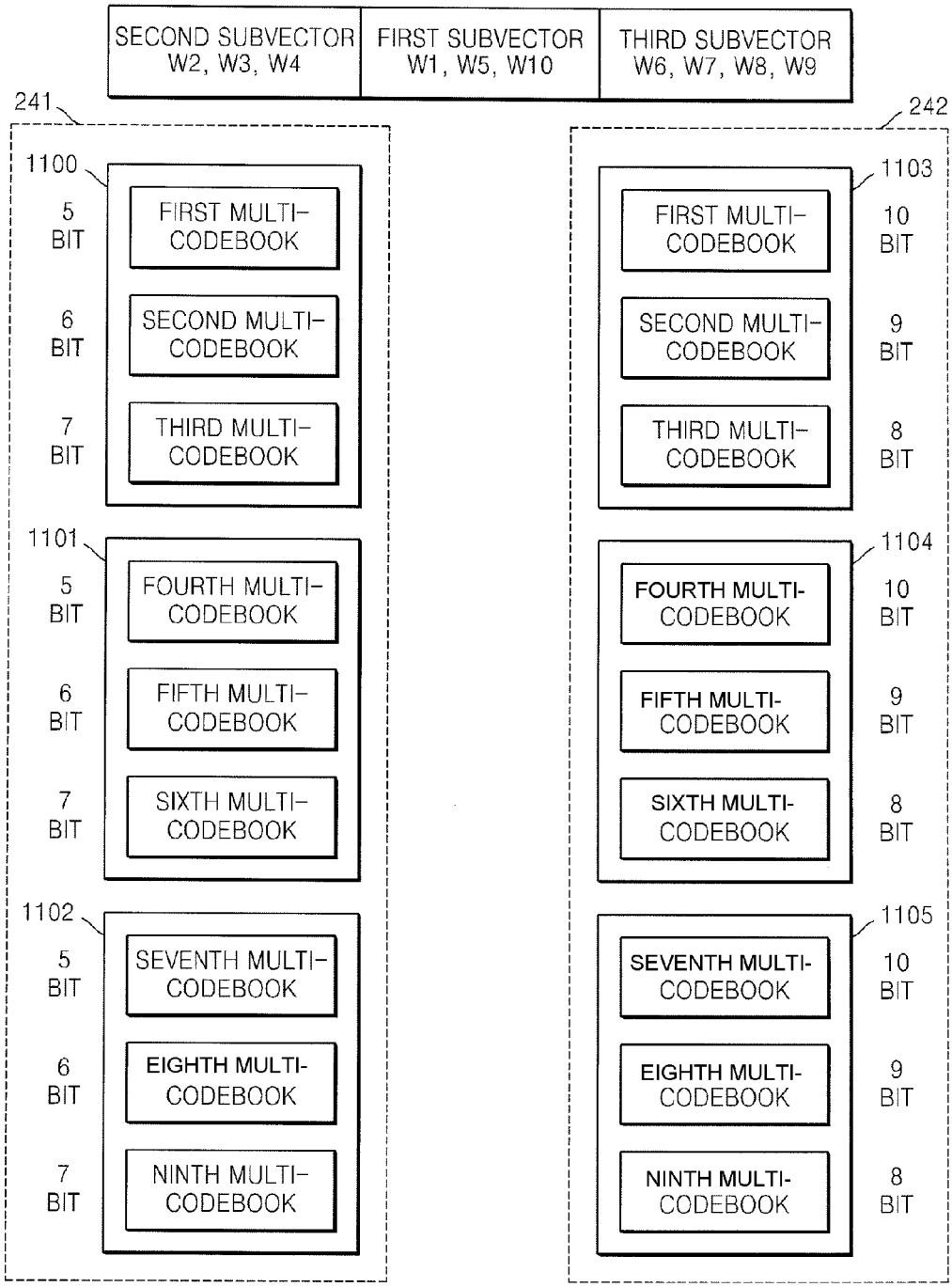
FIG. 11 is a conceptual diagram illustrating a method of storing codebooks according to another embodiment of the present general inventive concept.

Second, a plurality of classes corresponding to a group of multi-codebooks that allocate a different available bit to each lower subvector may be configured as illustrated in FIG. 11 and stored accordingly. In this case, a class is selected from the plurality of classes, and a codebook is selected from the selected class according to a bit allocated to each lower subvector. For example, when it is assumed that an available bit is 24 bits and the first subvector 711 uses 9 bits, if a first class 1100 and a fourth class 1103 are selected, a first multi-codebook to which 5 bits are allocated is selected from the first class 1100, and a first multi-codebook to which 10 bits are allocated is selected from the fourth class 1103. When the first class 1100 and a sixth class 1105 are selected, a third multi-codebook to which 7 bits are allocated is selected from the first class 1100, and a ninth multi-codebook to which 8 bits are allocated is selected from the sixth class 1105.

Each lower subvector is quantized using the codebook selected in operation 120 and a codebook index is generated (operation 130).

A normalized codebook may be used in operation 130. The normalized codebook is obtained after a value of whichever is smaller between the elements of the upper subvector is subtracted from each codeword of each lower subvector between the elements of the upper subvector and then a result of subtraction is divided by a difference between the elements of the upper subvector. For example, w1, which is a smaller element between w1 and w5 among the elements w1, w5 and w10 of the upper subvector, i.e., the first subvector 711, is subtracted from each codeword of the second subvector 712 between w1 and w5, and the result of subtraction is divided by (w5−w1), which is the difference between elements w1 and w5. In addition, w5, which is a smaller element between w5 and w10, is subtracted from each element of the third subvector 713 between w5 and w10, and the result of subtraction is divided by (w10−w5), which is the difference between w5 and w10.

When the quantization operation is performed in operation 130 using the codebook selected in operation 120, each codeword value of the selected codebook is multiplied by a value corresponding to the difference between the elements of the quantized upper subvector. Then, a value of a smaller element between the elements of the upper subvector is added to a result of multiplication, and a codebook index having a smallest distortion is detected.

Operations 120 and 130 are repeatedly performed on N codebook indices generated in operation 110. In other words, a codebook of each lower subvector for each of the N codebook indices generated using the upper subvector in operation 110 is selected in operation 120, and each lower subvector is quantized in operation 130 using each of the N generated codebook indices of each lower subvector selected in operation 120.

The codebook index having the smallest distortion is detected from the N codebook indices generated in operation 110 (operation 140). In other words, the codebook index having the smallest distortion is detected from the N codebook indices of the first subvector 711, and a codebook index of the second subvector 712 and a codebook index of the third subvector 713 corresponding to the detected codebook index are detected in operation 140.

The codebook indices detected in operation 140 are generated as a bitstream and transmitted accordingly (operation 150). In other words, the first, second, and third codebook indices of the first, second, and third subvectors 711 through 713 are generated as a bitstream and transmitted accordingly.

Figure 2:
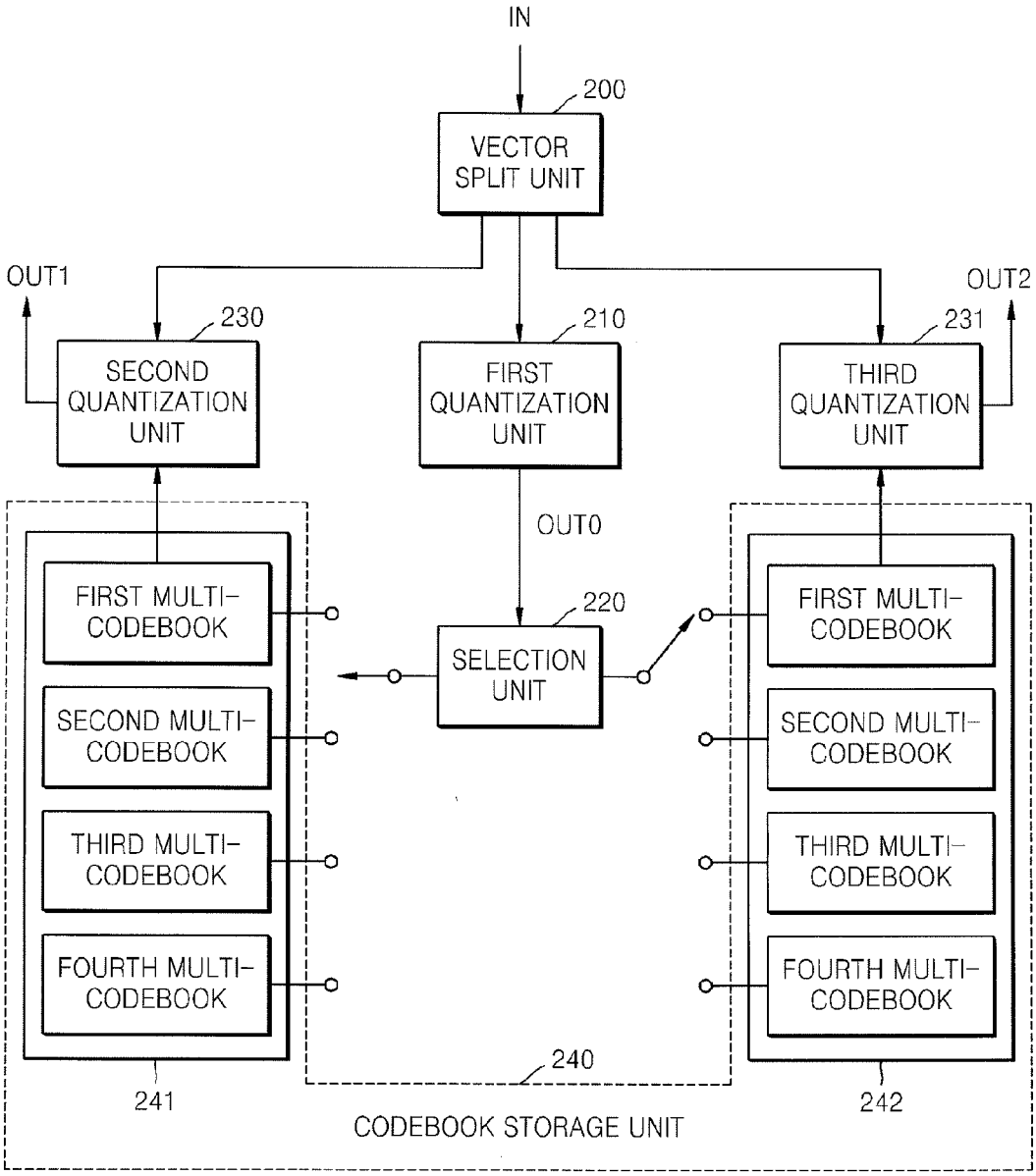
FIG. 2 is a block diagram illustrating an apparatus to quantize an LPC coefficient according to an embodiment of the present general inventive concept.

FIG. 2 is a block diagram illustrating an apparatus to quantize an LPC coefficient according to an embodiment of the present general inventive concept. The apparatus includes a vector split unit 200, a first quantization unit 210, a selection unit 220, a second quantization unit 230, a third quantization unit 231, and a codebook storage unit 240. The apparatus will now be described with reference to FIGS. 7 through 11.

The vector split unit 200 receives a vector of a coefficient having order characteristics (e.g., an LSF coefficient), which was converted from an LPC coefficient, through an input terminal IN and splits the vector into an upper subvector and lower subvectors. Here, the coefficient having order characteristics may be any one of an LSF, an LSP, ISFs and an ISP coefficient. The upper subvector obtained after the vector split unit 200 splits the vector of the coefficient having order characteristics is composed of anchor elements among elements that constitute the vector of the coefficient having order characteristics. Each of the lower subvectors is composed of elements respectively interposed between the elements of the upper subvector, among the elements that constitute the vector of the coefficient having order characteristics.

Referring to FIG. 7, the upper subvector corresponds to the first subvector 711, and the lower subvectors correspond to the second and third subvectors 712 and 713. In this case, the first subvector 711 is composed of elements w1, w5 and w10. The second subvector 712 interposed between elements w1 and w5 is composed of elements w2, w3 and w4, and the third subvector 713 interposed between elements w5 and w10 is composed of elements w6, w7, w8 and w9.

The first quantization unit 210 vector-quantizes the upper subvector obtained after the vector split unit 200 splits the vector of the coefficient having order characteristics into a codebook index. Specifically, the first quantization unit 210 quantizes the first subvector 711 into a first codebook index and outputs the first codebook index through an output terminal OUT0.

The first quantization unit 210 may generate N codebook indices, not just one codebook index, for the upper subvector to obtain an optimal combination of vectors of the coefficient having order characteristics.

The selection unit 220 selects a codebook, in which an available bit is allocated to each lower subvector using the elements of the upper subvector quantized by the first quantization unit 210 and according to distribution of the elements of each lower subvector from the codebook storage unit 240. In other words, the selection unit 220 selects a codebook for the second subvector 712 from a second multi-codebook storage unit 241 and a codebook for the third subvector 713 from a third multi-codebook storage unit 242. The selection unit 220 determines a distribution of the elements of the second subvector 712 using elements w1 and w5 of the first subvector 711 and selects a codebook in which an available bit is allocated to the second subvector 712. The selection unit 220 determines a distribution of the elements of the third subvector 713 using elements w5 and w10 of the first subvector 711 and selects a codebook in which an available bit is allocated to the third subvector 713.

The selection unit 220 may select a codebook from the second or third multi-codebook storage unit 241 and 242 using the elements of the upper subvector according to the embodiments of the present general inventive concept.

According to an embodiment of the present general inventive concept, a codebook, in which an available bit is allocated to each lower subvector according to a ratio of intervals between the elements of the upper subvector quantized by the first quantization unit 210, is selected. In FIG. 8, reference character s indicates a ratio of intervals between the elements of the upper subvector, which corresponds to a value of (w5−w1)/(w10−w5) in FIG. 7. As an interval between elements w1 and w5 increases versus an interval between elements w5 and w10, a number of bits allocated to the second subvector 712 between w1 and w5 is gradually increased. Therefore, a number of bits allocated to a multi-codebook stored in the second multi-codebook storage unit 241 are increased from M bits to (M+3) bits. Conversely, as a number of bits allocated to the third subvector 713 between elements w5 and w10 is gradually reduced, a number of bits allocated to a multi-codebook stored in the third multi-codebook storage unit 242 is reduced from L bits to (L−3) bits.

According to another embodiment of the present general inventive concept, a codebook, in which an available bit is allocated to each lower subvector according to an existence range of a predetermined quantized element among the elements of the quantized upper subvector, is selected. An anchor element, which greatly affects a distribution of the elements of each lower subvector, is selected from the elements of the upper subvector and preset as the predetermined quantized element. Referring to FIG. 9, when it is assumed that x denotes w5, a codebook, in which an available bit is allocated each lower subvector according to an existence range of w5, is selected.

The second quantization unit 230 quantizes the second subvector 712 using the codebook selected by the selection unit 220 from the second multi-code storage unit 241 and generates a second codebook index. Then, the second quantization unit 230 outputs the second codebook index through the output terminal OUT1.

The third quantization unit 231 quantizes the third subvector 713 using the codebook selected by the selection unit 220 from the third multi-code storage unit 242 and generates a third codebook index. Then, the third quantization unit 231 outputs the third codebook index through an output terminal OUT2.

The codebook storage unit 240 stores codebooks in which available bits are allocated to each lower subvector according to the distribution of the elements of each lower subvector among the elements of the vector of the coefficient having order characteristics. The codebook storage unit 240 includes the second multi-codebook storage unit 241 and the third multi-codebook storage unit 242.

The second multi-codebook storage unit 241 stores multi-codebooks for the second subvector 712. The third multi-codebook storage unit 242 stores multi-codebooks for the third subvector 713.

The second and third multi-codebook storage units 241 and 242 store codebooks using the following methods.

First, a plurality of multi-codebooks to store various codebooks according to an available bit allocated to each lower subvector may be configured as illustrated in FIG. 10 and stored accordingly.

Second, a plurality of classes corresponding to a group of multi-codebooks that allocate a different available bit to each lower subvector may be configured as illustrated in FIG. 11 and stored accordingly. In this case, the selection unit 220 selects a class from the plurality classes and selects a codebook from the selected class according to a bit allocated to each lower subvector. For example, when it is assumed that an available bit is 24 bits and the first subvector 711 uses 9 bits, if the first class 1100 and the fourth class 1103 are selected, the first multi-codebook to which 5 bits are allocated is selected from the first class 1100, and the first multi-codebook to which 10 bits are allocated is selected from the fourth class 1103. When the first class 1100 and the sixth class 1105 are selected, the third multi-codebook to which 7 bits are allocated is selected from the first class 1100, and the ninth multi-codebook to which 8 bits are allocated is selected from the sixth class 1105.

A codebook stored in the codebook storage unit 240 may be normalized. The normalized codebook is obtained after a value of whichever is smaller between the elements of the upper subvector is subtracted from each codeword of each lower subvector between the elements of the upper subvector and then a result of subtraction is divided by a difference between the elements of the upper subvector. For example, w1, which is a smaller element between the two elements w1 and w5 among the elements w1, w5 and w10 of the upper subvector, i.e., the first subvector 711, is subtracted from each codeword of the second subvector 712 between elements w1 and w5, and the result of the subtraction is divided by (w5−w1), which is the difference between elements w1 and w5. In addition, w5, which is a smaller element between the two elements w5 and w10, is subtracted from each element of the third subvector 713 between the elements w5 and w10, and the result of the subtraction is divided by (w10−w5), which is the difference between the elements w5 and w10.

The second and third quantization units 230 and 240 perform quantization using the normalized codebook. Specifically, each of the second and third quantization units 230 and 240 multiplies each codeword value of the codebook selected by the selection unit 220 by a value corresponding to the difference between the elements of the quantized upper subvector. Then, each of the second and third quantization units 230 and 240 adds a value of a smaller element between the elements of the upper subvector to a result of multiplication and detects a codebook index having a smallest distortion.

The selection and quantization operations are repeatedly performed on N codebook indices generated by the first quantization unit 210, and a codebook index having a smallest distortion is detected from the N codebook indices. In other words, a codebook index having the smallest distortion is detected from N codebook indices of the first subvector 711, and a codebook index of the second subvector 712 and a codebook index of the third subvector 713 corresponding to the detected codebook index are detected. The detected first, second, and third codebook indices of the first through third subvectors 711 through 713 are generated as a bitstream and transmitted accordingly.

Figure 3:
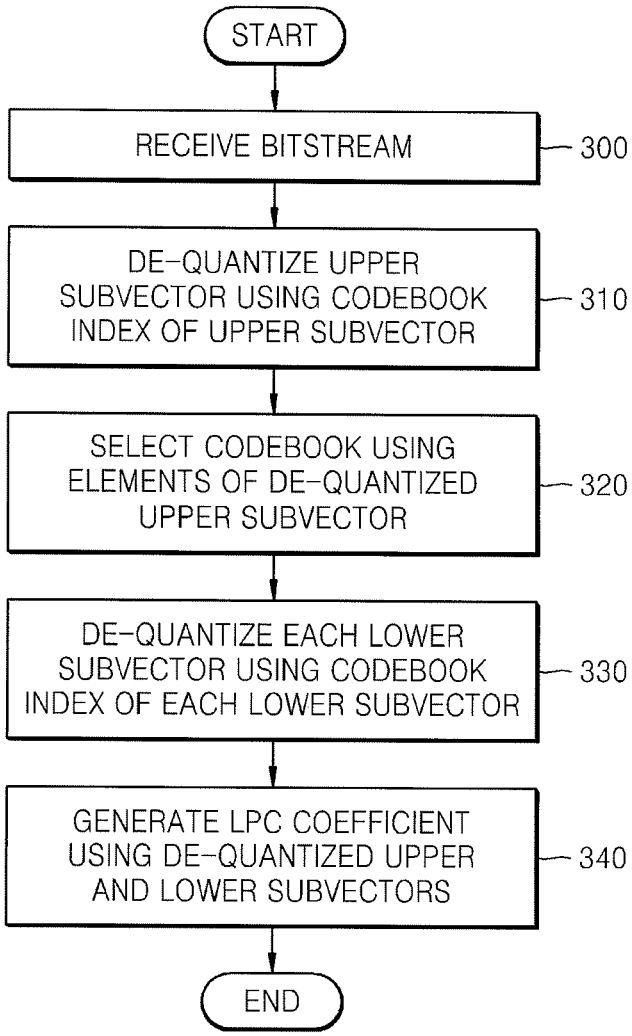
FIG. 3 is a flowchart illustrating a method of de-quantizing an LPC coefficient according to an embodiment of the present general inventive concept.

FIG. 3 is a flowchart illustrating a method of de-quantizing an LPC coefficient according to an embodiment of the present general inventive concept.

A bitstream, which includes codebook indices generated after a vector of a coefficient having order characteristics, which was converted from an LPC coefficient, is split into an upper subvector and lower subvectors and quantized accordingly, is received (operation 300). Here, the coefficient having order characteristics may be any one of an LSF, an LSP, ISFs and an ISP. The upper subvector includes anchor elements among elements that constitute the vector of the coefficient having order characteristics. Each of the lower subvectors includes elements respectively interposed between the elements of the upper subvector, among the elements that constitute the vector of the coefficient having order characteristics.

The upper subvector is de-quantized using a codebook index of the upper subvector that is included in the bitstream received in operation 300 (operation 310). In other words, the first subvector 711 is de-quantized into elements w1, w5 and w10 in operation 310.

A codebook of each lower subvector is selected using the elements of the upper subvector de-quantized in operation 310 (operation 320).

A code vector corresponding to a codebook index of each lower subvector is selected from the codebook of each lower subvector selected in operation 320 and de-quantized (operation 330).

The LPC coefficient is generated using the upper and lower subvectors de-quantized in operations 310 and 320 (operation 340).

Figure 4:
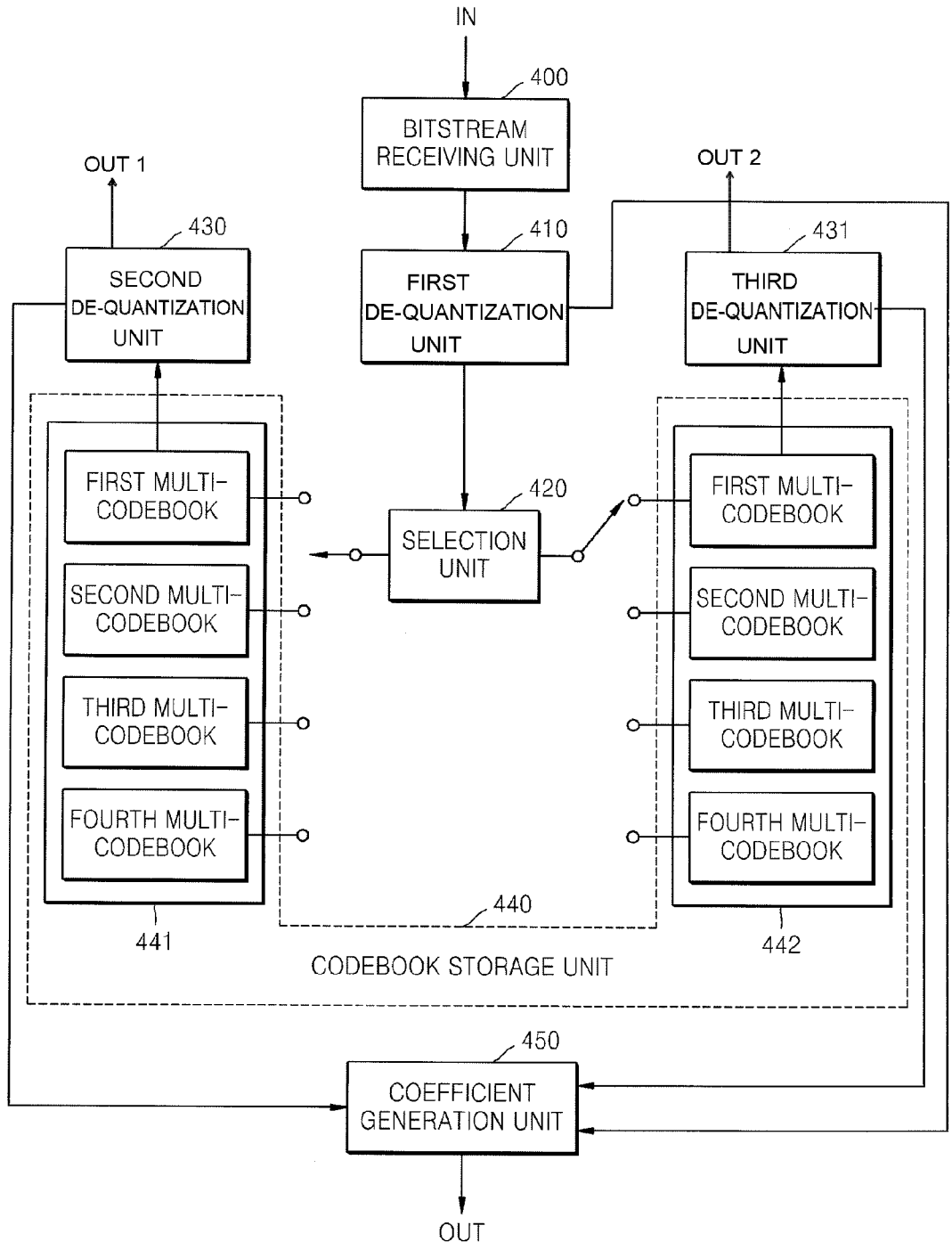
FIG. 4 is a block diagram illustrating an apparatus to de-quantize an LPC coefficient according to an embodiment of the present general inventive concept.

FIG. 4 is a block diagram illustrating an apparatus to de-quantize an LPC coefficient according to an embodiment of the present general inventive concept. Referring to FIG. 4, the apparatus to de-quantize an LSF includes a bitstream receiving unit 400, a first de-quantization unit 410, a selection unit 420, a second de-quantization unit 430, a third de-quantization unit 431, a codebook storage unit 440, and a coefficient generation unit 450.

The bitstream receiving unit 400 receives a bitstream, which includes codebook indices generated after a vector of a coefficient having order characteristics, which was converted from an LPC coefficient, is received through an input terminal IN, split into an upper subvector and lower subvectors, and quantized accordingly. The upper subvector includes anchor elements among elements that constitute the vector of the coefficient having order characteristics. Each of the lower subvectors includes elements respectively interposed between the elements of the upper subvector, among the elements that constitute the vector of the coefficient having order characteristics. Here, the coefficient having order characteristics may be any one of an LSF, an LSP, ISFs and an ISP.

The first de-quantization unit 410 de-quantizes the upper subvector using a codebook index of the upper subvector that is included in the bitstream received from the bitstream receiving unit 400. In other words, the first de-quantization unit 410 de-quantizes the first subvector 711 into elements w1, w5 and w10 and outputs a result of the de-quantization performed by the first de-quantization unit 410 and outputs the elements w1, w5 and w10 received from the first quantization unit 410 through an output terminal OUT0.

The selection unit 420 selects a codebook of each lower subvector using the elements of the upper subvector de-quantized by the first de-quantization unit 410.

The second de-quantization unit 430 selects a code vector corresponding to a codebook index of the second subvector 712 from the codebook of the second subvector 712 which was selected by the selection unit 420 from multi-codebooks stored in a second multi-codebook storage unit 441 and de-quantizes the code vector. Then, the second de-quantization unit 430 outputs a result of the de-quantization through an output terminal OUT1.

The third de-quantization unit 431 selects a code vector corresponding to a codebook index of the third subvector 713 from the codebook of the third subvector 713 which was selected by the selection unit 420 from multi-codebooks stored in a third multi-codebook storage unit 442 and de-quantizes the code vector. Then, the third de-quantization unit 431 outputs a result of the de-quantization through an output terminal OUT2.

The coefficient generation unit 450 generates the LPC coefficient using the upper subvector and the lower subvectors de-quantized by the second and third de-quantization units 430 and 431, respectively.

Figure 5:
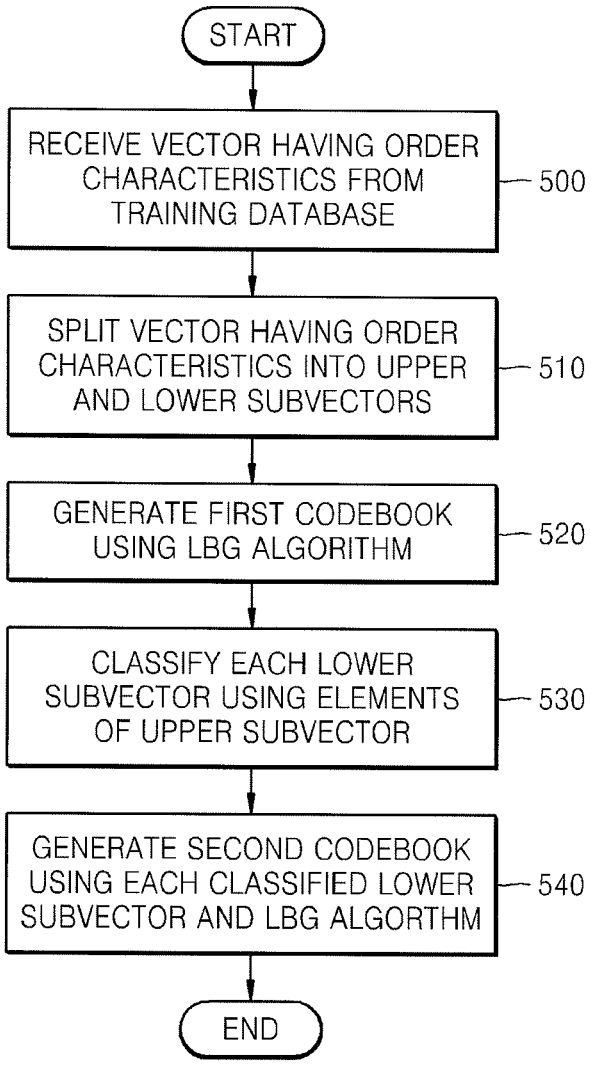
FIG. 5 is a flowchart illustrating a method of generating a codebook according to an embodiment of the present general inventive concept.

FIG. 5 is a flowchart illustrating a method of generating a codebook according to an embodiment of the present general inventive concept.

Referring to FIG. 5, a vector of a coefficient having order characteristics is received from a training database (operation 500). Here, the coefficient having order characteristics may be any one of an LSF, an LSP, ISFs and an ISP.

The vector of the coefficient having order characteristics, which was received in operation 500, is split into an upper subvector and lower subvectors (operation 510). The upper subvector obtained after the vector of the coefficient having order characteristics is split in operation 510 includes anchor elements among elements that constitute the vector of the coefficient having order characteristics. Each of the lower subvectors includes elements respectively interposed between the elements of the upper subvector, among the elements that constitute the vector of the coefficient having order characteristics.

The upper subvector is set, taking the following considerations into account. Generally, a narrowband speech codec uses a 10th coefficient, and a wideband speech codec uses a 16th or higher coefficient.

First, a maximum vector quantization dimension is set equal to or less than 4 in a case of the 10th coefficient and is set equal to or less than 6 in a case of the 16th coefficient. That is because a size of a codebook becomes too large and a performance of a normalized codebook deteriorates when a vector quantization dimension exceeds 4 or 6.

Second, a number of elements of the upper subvector which normalize are set equal to or less than 3 in the case of the 10th coefficient and is set equal to or less than 5 in the case of the 16th coefficient. A maximum number of elements of the upper subvector which normalize can be equal to or less than 4 in the case of the 10th coefficient and can be equal to or less than 6 in the case of the 16th coefficient. This is because vector quantization performance deteriorates and an intra-frame (I-frame) correlation between adjacent elements cannot be used when a large number of elements of the upper subvector is used to normalize a codebook.

Third, the upper subvector is configured such that the I-frame correlation between adjacent elements of the upper subvector is highest since the performance of the normalized codebook deteriorates when intervals between the elements are large.

Fourth, the upper subvector is configured such that the elements of the upper subvector are placed on both sides of each lower subvector. This is because the performance of a normalized codebook is better when each lower subvector is interposed between the elements of the upper subvector than when the elements of the upper subvector are placed on just one side of each lower subvector.

Fifth, the elements of the upper subvector are rendered non-continuous to effectively allocate an available bit to each lower subvector on both sides of each of the elements of the upper subvector.

A first codebook for the upper subvector obtained after the vector of the coefficient having order characteristics is split in operation 510 is generated using a Linde, Buzo and Gray (LBG) algorithm (operation 520).

An available bit is allocated to each lower subvector using the elements of the upper subvector obtained after the vector of the coefficient having order characteristics is split in operation 510, and each lower subvector is classified accordingly (operation 530).

Each lower subvector may be classified by allocating an available bit to each lower subvector in operation 530 according to the following exemplary embodiments of the present general inventive concept.

According to an embodiment of the present general inventive concept, each lower subvector is classified by allocating an available bit to each lower subvector according to a ratio of intervals between the elements of the upper subvector. In FIG. 8, reference character s indicates a ratio of intervals between the elements of the upper subvector, which corresponds to a value of (w5−w1)/(w10−w5) in FIG. 7. As an interval between elements w1 and w5 increases versus an interval between elements w5 and w10, a number of bits allocated to the second subvector 712 between elements w1 and w5 is gradually increased. Conversely, a number of bits allocated to the third subvector 713 between elements w5 and w10 is gradually reduced.

According to another embodiment of the present general inventive concept, each lower subvector is classified by allocating an available bit to each lower subvector according to an existence range of a predetermined quantized element among the elements of the upper subvector. An anchor element, which greatly affects a distribution of the elements of each lower subvector, is selected from the elements of the upper subvector. When it is assumed that the selected element x is w5, a codebook, in which an available bit is allocated each lower subvector according to an existence range of w5, is selected.

A second codebook for each lower subvector classified in operation 530 is generated using the LBG algorithm (operation 540).

The second codebook generated using the LBG algorithm in operation 540 may be normalized. The normalized codebook is obtained after a value of whichever is smaller between the elements of the upper subvector is subtracted from each codeword of each lower subvector between the elements of the upper subvector and then a result of subtraction is divided by a difference between the elements of the upper subvector. For example, w1, which is a smaller element between elements w1 and w5 among the elements w1, w5 and w10 of the upper subvector, i.e., the first subvector 711, is subtracted from each codeword of the second subvector 712 between w1 and w5, and the result of subtraction is divided by (w5−w1), which is the difference between elements w1 and w5. In addition, w5, which is a smaller element between elements w5 and w10, is subtracted from each element of the third subvector 713 between elements w5 and w10, and the result of subtraction is divided by (w10-w5), which is the difference between elements w5 and w10.

Figure 6:
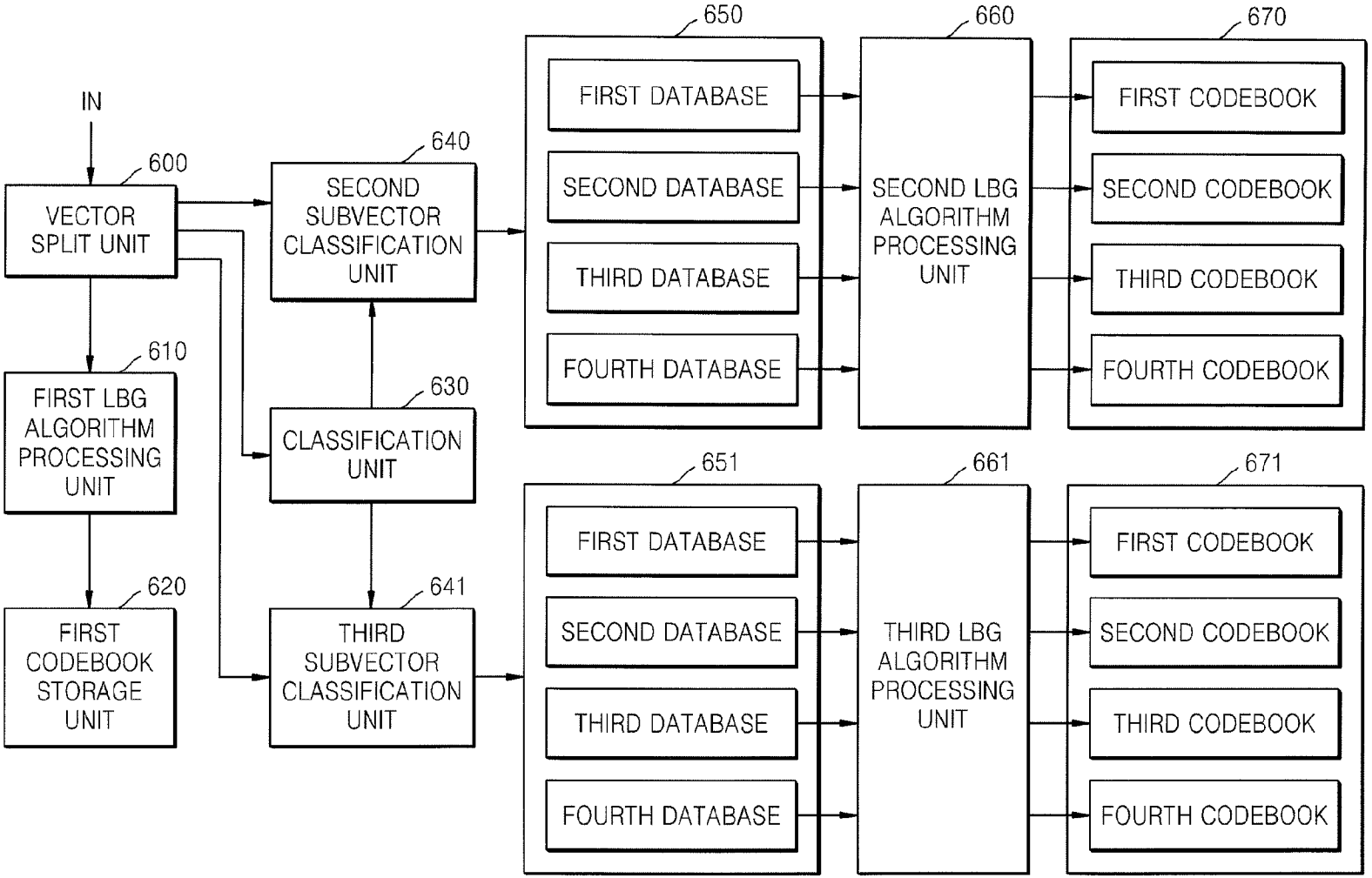
FIG. 6 is a block diagram of an apparatus to generate a codebook according to an embodiment of the present general inventive concept.

FIG. 6 is a block diagram illustrating an apparatus to generate a codebook according to an embodiment of the present general inventive concept. Referring to FIG. 6, the apparatus includes a vector split unit 600, a first LBG algorithm processing unit 610, a first codebook storage unit 620, a classification unit 630, a second subvector classification unit 640, a third subvector classification unit 641, a second database storage unit 650, a third database storage unit 651, a second LBG algorithm processing unit 660, a third LBG algorithm processing unit 661, a second codebook storage unit 670, and a third codebook storage unit 671.

The vector split unit 600 receives a vector of a coefficient having order characteristics from a training database through an input terminal IN and splits the vector into an upper subvector and lower subvectors. Here, the coefficient having order characteristics may be any one of an LSF, an LSP, ISFs and an ISP. The upper subvector obtained after the vector split unit 600 split the vector of the coefficient having order characteristics is composed of anchor elements among elements that constitute the vector of the coefficient having order characteristics. Each of the lower subvector is composed of elements respectively interposed between the elements of the upper subvector, among the elements that constitute the vector of the coefficient having order characteristics.

The upper subvector obtained after the vector split unit 600 splits the vector of the coefficient having order characteristics is set, taking the following considerations into account. Generally, a narrowband speech codec uses a 10th coefficient, and a wideband speech codec uses a 16th or higher coefficient.

First, a maximum vector quantization dimension is set equal to or less than 4 in a case of a 10th coefficient and is set equal to or less than 6 in the case of a 16th coefficient. That is because a size of a codebook becomes too large and a performance of a normalized codebook deteriorates when a vector quantization dimension exceeds 4 or 6.

Second, a number of elements of the upper subvector which normalize are set equal to or less than 3 in the case of the 10th coefficient and is set equal to or less than 5 in the case of the 16th coefficient. A maximum number of elements of the upper subvector which normalize can be equal to or less than 4 in the case of the 10th coefficient and can be equal to or less than 6 in the case of the 16th coefficient. This is because vector quantization performance deteriorates and an intra-frame (I-frame) correlation between adjacent elements cannot be used when a large number of elements of the upper subvector is used to normalize a codebook.

Third, the upper subvector is configured such that the I-frame correlation between adjacent elements of the upper subvector is highest since a performance of a normalized codebook deteriorates when intervals between the elements are large.

Fourth, the upper subvector is configured such that the elements of the upper subvector are placed on both sides of each lower subvector. This is because the performance of the normalized codebook is better when each lower subvector is interposed between the elements of the upper subvector than when the elements of the upper subvector are placed on just one side of each lower subvector.

Fifth, the elements of the upper subvector are rendered non-continuous to effectively allocate an available bit to each lower subvector on both sides of each of the elements of the upper subvector.

The first LBG algorithm processing unit 610 generates a codebook for the first subvector 711 obtained after the vector split unit 600 split the vector of the coefficient having order characteristics using the LBG algorithm.

The first codebook storage unit 620 stores the codebook for the first subvector 711 generated by the first LBG algorithm processing unit 610.

The classification unit 630 classifies the second subvector 712 and the third subvector 713 by allocating an available bit to each of the second and third subvectors 712 and 713 using the elements of the upper subvector obtained after the vector split unit 600 split the vector of the coefficient having order characteristics.

The classification unit 630 may classify each lower subvector by allocating an available bit to each lower subvector according to the two embodiments of the present general inventive concept.

According to an embodiment of the present general inventive concept, each lower subvector is classified by allocating an available bit to each lower subvector according to a ratio of intervals between the elements of the upper subvector. In FIG. 8, reference character s indicates a ratio of intervals between the elements of the upper subvector, which corresponds to a value of (w5−w1)/(w10−w5) in FIG. 7. As an interval between w1 and w5 increases versus an interval between elements w5 and w10, a number of bits allocated to the second subvector 712 between elements w1 and w5 are gradually increased. Conversely, a number of bits allocated to the third subvector 713 between elements w5 and w10 are gradually reduced.

According to another embodiment of the present general inventive concept, each lower subvector is classified by allocating an available bit to each lower subvector according to an existence range of a predetermined quantized element among the elements of the upper subvector. An anchor element, which greatly affects a distribution of the elements of each lower subvector, is selected from the elements of the upper subvector. When it is assumed that the selected element x is w5, a codebook, in which an available bit is allocated each lower subvector according to an existence range of w5, is selected.

The second subvector classification unit 640 stores the second subvector 712 classified by the classification 640 in the second database storage unit 650.

The third subvector classification unit 641 stores the third subvector 713 classified by the classification unit 630 in the third database storage unit 651.

The second LBG algorithm processing unit 660 generates a codebook for the second subvector stored in the second database storage unit 650 using the LBG algorithm.

The third LBG algorithm processing unit 661 generates a codebook for the third subvector 713 stored in the third database storage unit 651 using the LBG algorithm.

The second codebook storage unit 670 stores the codebook for the second subvector generated by the second LBG algorithm processing unit 660.

The third codebook storage unit 671 stores the codebook for the third subvector 713 generated by the third LBG algorithm processing unit 661.

The second database storage unit 650 and the third database storage unit 651 may normalize a codebook using the elements of the first quantized subvector 711. The normalized codebook is obtained after a value of whichever is smaller between the elements of the upper subvector is subtracted from each codeword of each lower subvector between the elements of the upper subvector and then a result of subtraction is divided by a difference between the elements of the upper subvector. For example, w1, which is a smaller element between the elements w1 and w5 among the elements w1, w5 and w10 of the upper subvector, i.e., the first subvector 711, is subtracted from each codeword of the second subvector 712 between the elements w1 and w5, and the result of subtraction is divided by (w5−w1), which is the difference between the elements w1 and w5. In addition, w5, which is a smaller element between the elements w5 and w10, is subtracted from each element of the third subvector 713 between elements w5 and w10, and a result of the subtraction is divided by (w10−w5), which is the difference between the elements w5 and w10.

Figure 12:
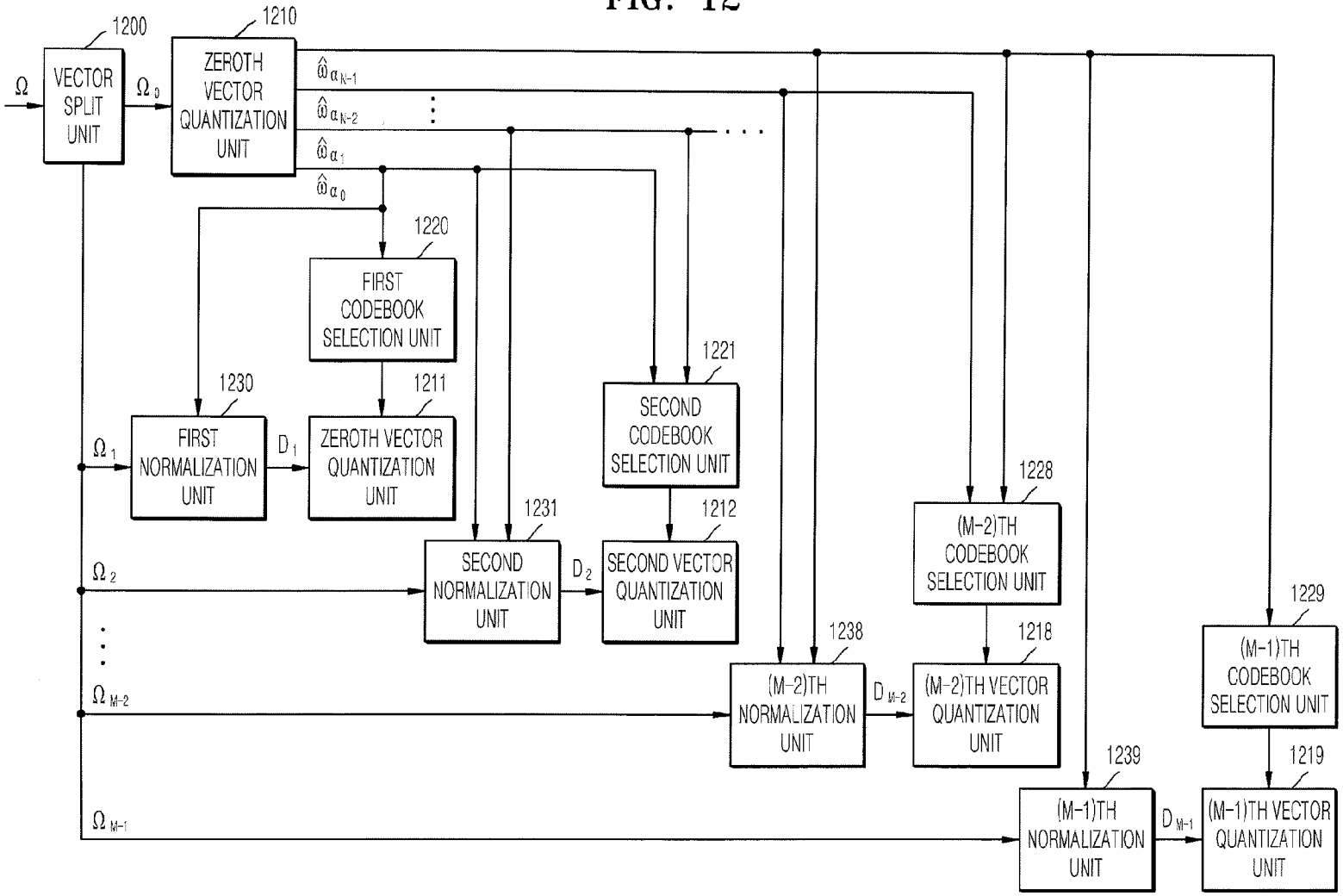
FIG. 12 is a block diagram of an apparatus for quantizing an LPC coefficient according to an embodiment of the present invention.
Figure 13:
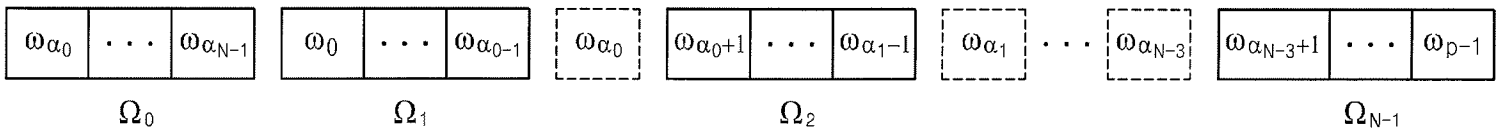
FIG. 13 is a conceptual diagram illustrating N subvectors into which a $p^{th}$ vector of a coefficient having order characteristics, which was converted from an LPC coefficient, is split according to an embodiment of the present invention.

FIG. 12 is a block diagram of an apparatus for quantizing an LPC coefficient according to an embodiment of the present invention. In FIG. 12, it is assumed that a $p^{th}$ vector S2 of a coefficient having order characteristics is as defined by Equation (1).

$$\Omega=[w_0, w_1, \ldots, w_{p-1}] \tag{1}$$

where $0<=w_0<w_1<\ldots<w_{p-1}<=\Pi$.

A vector split unit 1200 splits the $p^{th}$ vector of the coefficient having the order characteristics, which was converted from an LPC coefficient, into N subvectors. Specifically, the vector split unit 1200 splits the $p^{th}$ vector into an upper subvector $\Omega_0$ and a plurality of lower subvectors $\Omega_1, \Omega_2, \ldots, \Omega_{N-1}$ as defined by Equation (2).

$$\Omega_0=\{\omega_{\alpha_0}, \omega_{\alpha_1}, \ldots, \omega_{\alpha_{N-3}}\},$$

$$\Omega_1=\{\omega_0, \omega_1, \ldots, \omega_{\alpha_0-1}\},$$

$$\Omega_2=\{\omega_{\alpha_0+1}, \omega_{\alpha_0+2}, \ldots, \omega_{\alpha_1-1}\},$$

$$\Omega_{N-1}=\{\omega_{\alpha_{N-3}+1}, \omega_{\alpha_{N-3}+2}, \ldots, \omega_{p-1}\}, \tag{2}$$

where $\alpha_i$ is $a_0<a_1<\ldots<a_{N-3}$.

A $zero^{th}$ vector quantization unit 1210 vector-quantizes the upper subvector $\Omega_0$ received from the vector split unit 1200, outputs $w'_{a_0}, w'_{a_1}, \ldots w'_{a_{N-1}}$, which are the results of quantizing elements $w_{a_0}, w_{a_1}, \ldots w_{a_{N-1}}$, and generates a codebook index.

Each of first through $(M-1)^{th}$ codebook selection unit 1220 through 1229 selects a codebook from a multi-codebook. Specifically, an available bit for each subvector is calculated according to the distribution of the elements $w_{a_0}, w_{a_1}, \ldots w_{a_{N-1}}$ of the upper subvector $\Omega_0$ which was vector-quantized by the $zero^{th}$ vector quantization unit 1210. Then, a codebook corresponding to the calculated bit is normalized and stored in the multi-codebook. Each of the first through $(M-1)^{th}$ codebook selection unit 1220 through 1229 selects the normalized codebook from the multi-codebook. For example, the first codebook selection unit 1220 selects a normalized codebook of the lower subvector $\Omega_1$ from the multi-codebook according to the distribution of the quantized element $w'_{a_0}$. The second codebook selection unit 1221 selects a normalized codebook of the lower subvector $\Omega_2$ from the multi-codebook according to the distribution of the quantized elements $w'_{a_1}$ and $w'_{a_2}$. The $(M-2)^{th}$ codebook selection unit 1228 selects a normalized codebook of the lower subvector $\Omega_{M-2}$ from the multi-codebook according to the distribution of the quantized elements $w'_{a_{N-2}}$ and $w'_{a_{N-1}}$. The $(M-1)^{th}$ codebook selection unit 1229 selects a normalized codebook of the lower vector $\Omega_{M-1}$ from the multi-codebook according to the distribution of the quantized element $w'_{a_{N-1}}$. Since the number of elements included in the upper subvector $\Omega_0$ is fixed to N−2, a bit allocated to the upper subvector $\Omega_0$ has a constant value. Each of the first through $(M-1)^{th}$ codebook selection units 1220 through 1229 calculates an available bit for each subvector using the following method.

A relative ratio value $r_n$ of a bit allocated to each lower subvector $\Omega_n$ is given by Equation (3).

$$\begin{aligned} r_1 &= \omega_{\alpha_0} - 0 \\ r_2 &= \omega_{\alpha_1} - \omega_{\alpha_0} \\ &\vdots \\ r_{N-1} &= \pi - \omega_{\alpha_{N-3}}, \end{aligned} \tag{3}$$

where a sum of $r_1$ through $r_{N-1}$ is $\pi$. Therefore, as the relative ratio value $r_n$ for a lower subvector $\Omega_n$ increases, the relative ratio values for the other subvectors are reduced. Consequently, smaller available bits are allocated to the other subvectors.

An available bit for each subvector $\Omega_n$ is determined by a range to the relative ratio value $r_n$ calculated as described above belongs and based on standards shown in Table 1.

TABLE 1

| Condition | Allocated bits in $\Omega_0$ | Allocated bits in $\Omega_1$ | Allocated bits in $\Omega_2$ | Allocated bits in $\Omega_3$ |
|---|---|---|---|---|
| $r_1 \le f1$ and $r_3 > \pi - f2$ | $k_0$ | $k_1 - \epsilon_1$ | $k_2$ | $k_3 + \epsilon_1$ |
| $r_1 \le f1$ and $r_3 \le \pi - f2$ | | $k_1 - \epsilon_1$ | $k_2 + \epsilon_1 + \epsilon_2$ | $k_3 - \epsilon_2$ |
| $r_1 > f1$ and $r_3 > \pi - f2$ | | $k_1 + \epsilon_1$ | $k_2 - \epsilon_1 - \epsilon_2$ | $k_3 + \epsilon_2$ |
| $r_1 > f1$ and $r_3 \le \pi - f2$ | | $k_1 + \epsilon_1$ | $k_2$ | $k_3 - \epsilon_1$ |

Here, $\xi_1$ and $\xi_2$ are control bits used to variably allocate bits.

Table 1 is based on the assumption that a tenth LSF vector having order characteristics is split into four subvectors $\Omega_0$, $\Omega_1$, $\Omega_2$, $\Omega_3$ and that an upper subvector $\Omega_0$ is split into two regions by boundary points f1 and f2 and has elements $w_2$ and $w_4$. In Table 1, $k_n$ is pre-allocated to each subvector $\Omega_n$, and a bit that is actually allocated to each subvector $\Omega_n$ varies according to $r_1$ and $r_2$.

In order to search for an optimised codeword, an actual subvector V and an approximated vector V' are defined by Equation (4).

$$d(V,V')=(V-V')\cdot W^T \quad (4).$$

Here, a vector W to which a variable weight is applied is defined by Equation (5).

$$w(i)=\begin{cases}\dfrac{50}{2\pi}+1, & \Delta(i)=0\\ \dfrac{0.5}{2\pi\Delta(i)}+1, & \text{otherwise,}\end{cases} \quad (5)$$

where $1 \le i \le p-1$, and $\Delta(i)$ is given by Equation (6).

$$\Delta(i)=\begin{cases}\omega(i+1)-\omega(i), & i=0\\ \min\{(\omega(i)-\omega(i-1)),(\omega(i+1)-\omega(i))\}, & 1\le i\le p-2\\ \omega(i)-\omega(i-1), & i=p-1.\end{cases} \quad (6)$$

First through $(M-1)^{th}$ normalization units 1230 through 1239 normalize elements of the lower subvectors $\Omega_1$, $\Omega_2$, . . . , $\Omega_{N-1}$ using $w'_{a_0}$, $w'_{a_1}$, . . . $w'_{a_{N-1}}$, which are the quantization results by the zero$^{th}$ vector quantization unit 1210, and Equation (7).

$$D_n=\begin{cases}\dfrac{\hat{\omega}_{\alpha_0}-\Omega_n}{\hat{\omega}_{\alpha_0}}, & n=1\\ \dfrac{\hat{\omega}_{\alpha_{n-1}}-\Omega_n}{\hat{\omega}_{\alpha_{n-1}}-\hat{\omega}_{\alpha_{n-2}}}, & n=2,\ldots,M-2\\ \dfrac{\pi-\Omega_n}{\pi-\hat{\omega}_{\alpha_{N-3}}}, & n=M-1.\end{cases} \quad (7)$$

The first through $(M-1)^{th}$ vector quantization units 1211 through 1219 search for codewords corresponding to normalized elements output from the first through $(M-1)^{th}$ normalization units 1230 through 1239 in the codebooks selected by the first through $(M-1)^{th}$ codebook selection units 1220 through 1229, respectively.

Apparatuses and methods to quantize and de-quantize an LPC coefficient according to the present general inventive concept split a vector of a coefficient having order characteristics, which was converted from an LPC coefficient, into a plurality of subvectors, selects a codebook in which an available bit is allocated to each subvector according to a distribution of elements of each subvector, and quantize each subvector using the selected codebook. Therefore, optimcal quantization can be performed.

Since the apparatuses and methods use a normalized codebook, quantization efficiency can be improved when coefficients having order characteristics, which were converted from LPC coefficients, have different average values.

In addition, the apparatuses and methods generate a plurality of codebook indices using an upper subvector. Therefore, more accurate quantization can be performed.

The present general inventive concept can also be implemented as computer (including all information processable devices)-readable code on a computer-readable recording medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Also, functional programs, codes, and code segments to accomplish the present general inventive concept can be easily construed by programmers skilled in the art to which the present general inventive concept pertains. The method illustrated in FIG. 1, 3, or 5 can be stored in the computer-recorded medium in a form of computer-readable codes to perform the method when the computer reads the computer-readable codes of the recording medium.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A method of converting a linear predictive coding (LPC) coefficient into a coefficient having order characteristics and quantizing the coefficient, the method comprising:

splitting a vector of the coefficient having the order characteristics into a plurality of subvectors;

selecting a codebook in which an available bit is allocated to each of the subvectors according to a distribution of elements of each of the subvectors; and quantizing, performed by using at least one processor, each of the subvectors using the selected codebook and generating a codebook index of each of the subvectors, wherein a different available bit is allocated to subvectors in each of a plurality of normalized codebooks for use in quantizing lower subvectors, according to a distribution of elements of the subvectors.

2. The method of claim 1, wherein the coefficient having the order characteristics is any one of a line spectrum frequency (LSF), a line spectral pair (LSP), immittance spectral frequencies (ISFs), and an immittance spectral pair (ISP) coefficient.

3. The method of claim 1, wherein the splitting of the vector of the coefficient comprises:

splitting the vector of the coefficient having the order characteristics into an upper subvector including anchor elements among elements that constitute the vector of the coefficient having the order characteristics and the lower subvectors, each including elements respectively interposed between the elements of the upper subvector.

4. The method of claim 3, wherein the selecting of the codebook comprises:

quantizing the upper subvector and generating a codebook index; and selecting a codebook in which an available bit is allocated to each lower subvector according to a ratio of intervals between elements of the quantized upper subvector.

5. The method of claim 3, wherein the selecting of the codebook comprises:

quantizing the upper subvector and generating a codebook index; and selecting a codebook in which an available bit is allocated to each lower subvector according to an existence range of a predetermined quantized element among the elements of the quantized upper subvector.

6. The method of claim 3, wherein the selecting of the codebook comprises:

quantizing the upper subvector and generating a plurality of codebook indices; and selecting codebooks in which available bits are respectively allocated to the lower subvectors using the generated codebook indices; and detecting a codebook index having a smallest distortion from the codebook indices using a result of the quantization.

7. The method of claim 3, wherein the codebook is normalized.

8. The method of claim 7, wherein the codebook is normalized using the elements of the upper subvector.

9. The method of claim 8, wherein the normalized codebook is obtained after a value of whichever is smaller between the elements of the upper subvector is subtracted from each codeword of each lower subvector between the elements of the upper subvector and then a result of the subtraction is divided by a value corresponding to a difference between the elements of the upper subvector.

10. The method of claim 8, wherein the quantizing of each of the subvectors comprises:

multiplying each codeword value of each lower subvector between the elements of the upper subvector by a value corresponding to the difference between the elements of the upper subvector;

and adding a value of a smaller element between the elements of the upper subvector to a result of the multiplication.

11. The method of claim 1, wherein the selecting of the codebook comprises:

selecting a group of codebooks in which a different available bit is allocated to each of the subvectors from a plurality of groups of codebooks; and selecting a codebook from the selected group according to a bit allocated to each of the subvectors.

12. A method of de-quantizing an LPC coefficient into an LSF using a codebook index generated after an encoder converts the LPC coefficient into a vector of a coefficient having order characteristics, splits the vector of the coefficient into an upper subvector and lower subvectors, and quantizes the upper and lower subvectors, the method comprising:

de-quantizing the upper subvector using a codebook index of the upper subvector;

selecting a codebook among a plurality of codebooks, using elements of the de-quantized upper subvector;

de-quantizing, performed by using at least one processor, each of the lower subvectors using a codebook index of each of the lower subvectors included in the selected codebook; and generating an LSF vector using the de-quantized upper subvector and the de-quantized lower subvectors, wherein a different available bit is allocated to subvectors in each of the plurality of codebooks, according to a distribution of elements of the subvectors.

13. The method of claim 12, wherein the coefficient having the order characteristics is any one of an LSF, an LSP, ISFs, and an ISP coefficient.

14. The method of claim 12, wherein the codebook is normalized.

15. The method of claim 14, wherein the codebook is normalized using the elements of the upper subvector.

16. The method of claim 15, wherein the normalized codebook is obtained after a value of whichever is smaller between the elements of the upper subvector is subtracted from each codeword of each lower subvector between the elements of the upper subvector and then a result of the subtraction is divided by a value corresponding to a difference between the elements of the upper subvector.

17. The method of claim 16, wherein the de-quantizing of the upper subvector and the lower subvectors comprises:

multiplying each codeword value of each lower subvector between the elements of the upper subvector by a value corresponding to the difference between the elements of the upper subvector; and adding a value of a smaller element between the elements of the upper subvector to a result of the multiplication.

18. A method of generating a codebook, the method comprising:

splitting a vector of a coefficient having order characteristics, which was converted from an LPC coefficient, into an upper subvector including of anchor elements among elements that constitute the vector of the coefficient having the order characteristics and lower subvectors, each including elements respectively interposed between the elements of the upper subvector;

classifying each of the lower subvectors by allocating an available bit to each of the lower subvectors using the upper subvector; and generating, performed by using at least one processor, a codebook by training the upper subvector and each of the classified subvectors, wherein a different available bit is allocated to subvectors in each of a plurality of codebooks for use in quantizing and dequantizing the lower subvectors, according to a distribution of elements of the subvectors.

19. The method of claim 18, wherein the coefficient having the order characteristics is any one of an LSF, an LSP, ISFs, and an ISP coefficient.

20. The method of claim 18, wherein the classifying of each of the lower subvectors comprises:

classifying each of the lower subvectors by allocating an available bit to each of the lower subvectors according to a ratio of intervals between elements of the upper subvector.

21. The method of claim 18, wherein the classifying of each of the lower subvectors comprises:

classifying each of the lower subvectors by allocating an available bit to each of the lower subvectors according to an existence range of a predetermined element among the elements of the upper subvector.

22. The method of claim 18, wherein, in the generating of the codebook, the upper subvector and each of the classified subvectors are trained using a Linde, Buzo and Gray (LBG) algorithm.

23. The method of claim 18, wherein, in the generating of the codebook, the codebook is normalized using the elements of the upper subvector.

24. The method of claim 23, wherein, in the generating of the codebook, the codebook is normalized after a value of whichever is smaller between the elements of the upper subvector is subtracted from each codeword of each lower subvector between the elements of the upper subvector and then a result of the subtraction is divided by a value corresponding to a difference between the elements of the upper subvector.

25. The method of claim 18, wherein a maximum vector quantization dimension is set equal to or less than four when the coefficient is a tenth coefficient, and a maximum vector quantization dimension is set equal to or less than six when the coefficient is a sixth coefficient.

26. The method of claim 18, wherein a number of the elements of the upper subvector are limited to be equal to or less than four when the coefficient is the tenth coefficient, and the number of the elements of the upper subvector are set equal to or less than six when the coefficient is the sixth coefficient.

27. The method of claim 18, wherein the upper subvector is configured such that an intra-frame correlation between the elements of the upper subvector can be highest.

28. The method of claim 18, wherein the upper subvector is configured such that the elements of the upper subvector are placed on both sides of each of the lower subvectors.

29. The method of claim 18, wherein the upper subvector is configured such that the elements of the upper subvector are non-continuous.

30. A method of quantizing a linear predictive coding (LPC) coefficient, comprising:

converting an LPC coefficient into a coefficient having a vector;

splitting the vector into an upper subvector and plural lower subvectors;

quantizing, performed by using at least one processor, the upper subvector to generate upper subvector codebook indices;

selecting a codebook for use with the lower subvectors from a plurality of codebooks stored in a codebook storage unit based on the upper subvector codebook indices;

quantizing the plural lower subvectors using the selected codebook;

selecting a codebook index having a smallest distortion from the upper subvector codebook indices comprising:

allocating available bits in a codebook to each of the plural lower subvectors according to a predetermined value;

generating a codebook index for the upper subvector and each of the plural lower subvectors as a bitstream; and transmitting the bitstream, wherein a different available bit is allocated to subvectors in each of the plurality of codebooks for use in quantizing the lower subvectors, according to a distribution of elements of the subvectors.

31. A non-transitory computer-readable medium having embodied thereon a computer program to execute a method of converting a linear predictive coding (LPC) coefficient into a coefficient having order characteristics and quantizing the coefficient, the method comprising:

splitting a vector of the coefficient having the order characteristics into a plurality of subvectors;

selecting a codebook among a plurality of codebooks, in which an available bit is allocated to each of the subvectors according to distribution of elements of each of the subvectors; and quantizing each of the subvectors using the selected codebook and generating a codebook index of each of the subvectors, wherein a different available bit is allocated to subvectors in each of the plurality of codebooks for use in quantizing lower subvectors, according to a distribution of elements of the subvectors.

32. A non-transitory computer-readable medium having embodied thereon a computer program to execute a method of de-quantizing an LPC coefficient into an LSF using a codebook index generated after an encoder converts the LPC coefficient into a vector of a coefficient having order characteristics, splits the vector of the coefficient into an upper subvector and lower subvectors, and quantizes the upper and lower subvectors, the method comprising:

de-quantizing the upper subvector using a codebook index of the upper subvector;

selecting a codebook among a plurality of codebooks, using elements of the de-quantized upper subvector;

de-quantizing each of the lower subvectors using a codebook index of each of the lower subvectors included in the selected codebook; and generating an LSF vector using the de-quantized upper subvector and the de-quantized lower subvectors, wherein a different available bit is allocated to subvectors in each of the plurality of codebooks for use in dequantizing the lower subvectors, according to a distribution of elements of the subvectors.

33. A non-transitory computer-readable medium having embodied thereon a computer program to execute a method of generating a codebook, the method comprising:

splitting a vector of a coefficient having order characteristics, which was converted from an LPC coefficient, into an upper subvector comprised of anchor elements among elements that constitute the vector of the coefficient having the order characteristics and lower subvectors, each comprised of elements respectively interposed between the elements of the upper subvector;

classifying each of the lower subvectors by allocating an available bit to each of the lower subvectors using the upper subvector; and generating a codebook by training the upper subvector and each of the classified subvectors, wherein a different available bit is allocated to subvectors in each of a plurality of codebooks for use in quantizing and dequantizing the lower subvectors, according to a distribution of elements of the subvectors.

34. A non-transitory computer-readable medium having embodied thereon a computer program to execute a method of quantizing a linear predictive coding (LPC) coefficient, comprising:

converting an LPC coefficient into a coefficient having a vector;

splitting the vector into an upper subvector and plural lower subvectors;

quantizing the upper subvector to generate upper subvector codebook indices;

selecting a codebook for use with the lower subvectors from a plurality of codebooks stored in a codebook storage unit based on the upper subvector codebook indices;

quantizing the plural lower subvectors using the selected codebook;

selecting a codebook index having a smallest distortion from the upper subvector codebook indices comprising:

allocating available bits in a codebook to each of the plural lower subvectors according to a predetermined value;

generating a codebook index for the upper subvector and each of the plural lower subvectors as a bitstream; and transmitting the bitstream, wherein a different available bit is allocated to subvectors in each of the plurality of codebooks for use in quantizing the lower subvectors, according to a distribution of elements of the subvectors.

35. An apparatus to convert an LPC coefficient into a coefficient having order characteristics and to quantize the coefficient, the apparatus comprising:

a vector split unit to split a vector of the coefficient having the order characteristics into a plurality of subvectors;

a codebook storage unit to store a plurality of codebooks in which an available bit is allocated to each of the subvectors according to a distribution of elements of each of the subvectors that constitute the vector of the coefficient having the order characteristics;

a codebook selection unit to select a codebook from the codebooks stored in the codebook storage unit according to the distribution of the elements of each of the subvectors; and a quantization unit to quantize each of the subvectors using the selected codebook and to generate a codebook index of each of the subvectors, wherein a different available bit is allocated to subvectors in each of the plurality of codebooks for use in quantizing the lower subvectors, according to a distribution of elements of the subvectors.

36. The apparatus of claim 35, wherein the coefficient having the order characteristics is any one of an LSF, an LSP, ISFs, and an ISP coefficient.

37. The apparatus of claim 36, wherein the vector split unit splits the vector of the coefficient having the order characteristics into an upper subvector comprised of anchor elements among elements that constitute the vector of the coefficient having the order characteristics and lower subvectors, each comprised of elements respectively interposed between the elements of the upper subvector.

38. The apparatus of claim 37 wherein the codebook selection unit comprises:

a quantization unit to quantize the upper subvector and to generate a plurality of codebook indices;

a selection unit to select codebooks in which available bits are respectively allocated to the lower subvectors using the generated plurality of codebook indices; and a detection unit to detect a codebook index having a smallest distortion from the codebook indices using the result of quantization.

39. The apparatus of claim 37, wherein the codebook storage unit stores normalized codebooks.

40. The apparatus of claim 39, wherein the codebook storage unit stores the codebooks normalized using the elements of the upper subvector.

41. The apparatus of claim 40, wherein the codebook storage unit stores the codebooks normalized after a value of whichever is smaller between the elements of the upper subvector is subtracted from each codeword of each lower subvector between the elements of the upper subvector and then a result of the subtraction is divided by a value corresponding to a difference between the elements of the upper subvector.

42. The apparatus of claim 41, wherein the quantization unit multiplies each codeword value of each lower subvector between the elements of the upper subvector by a value corresponding to the difference between the elements of the upper subvector and adds a value of a smaller element between the elements of the upper subvector to a result of the multiplication.

43. The apparatus of claim 36, wherein the codebook storage unit stores a plurality of groups of codebooks in which a different available bit is allocated to each of the subvectors, and the codebook selection unit comprises a first selection unit to select a group of codebooks from the groups of codebooks and a second selection unit to select a codebook from the selected group according to a bit allocated to each of the subvectors.

44. The apparatus of claim 35, wherein the codebook selection unit comprises:

a first quantization unit to quantize the upper subvector and to generate a codebook index; and a selection unit to select a codebook in which an available bit is allocated to each lower subvector according to a ratio of intervals between elements of the quantized upper subvector.

45. An apparatus to de-quantize an LPC coefficient into an LSF using a codebook index generated after an encoder converts the LPC coefficient into a vector of a coefficient having order characteristics, splits the vector of the coefficient into an upper subvector and lower subvectors, and quantizes the upper subvector and the lower subvectors, the apparatus comprising:

a first de-quantization unit to de-quantize the upper subvector using a codebook index of the upper subvector;

a codebook storage unit storing a plurality of codebooks in which an available bit is allocated to each of the subvectors according to distribution of elements of each of the subvectors that constitute the vector of the coefficient having the order characteristics;

a codebook selection unit to select a codebook from the codebooks stored in the codebook storage unit using elements of the de-quantized upper subvector;

a second de-quantization unit to de-quantize each of the lower subvectors using a codebook index of each of the lower subvectors included in the selected codebook; and a coefficient generation unit to generate an LSF vector using the de-quantized upper subvector and the de-quantized lower subvectors, wherein a different available bit is allocated to subvectors in each of the plurality of codebooks for use in dequantizing the lower subvectors, according to a distribution of elements of the subvectors.

46. The apparatus of claim 45, wherein the coefficient having the order characteristics is any one of an LSF, an LSP, ISFs, and an ISP coefficient.

47. The apparatus of claim 45, wherein the codebook storage unit stores normalized codebooks.

48. The apparatus of claim 47, wherein the codebook storage unit stores the codebooks normalized using the elements of the upper subvector.

49. The apparatus of claim 48, wherein the codebook storage unit stores the codebooks normalized after a value of whichever is smaller between the elements of the upper subvector is subtracted from each codeword of each lower subvector between the elements of the upper subvector and then a result of the subtraction is divided by a value corresponding to a difference between the elements of the upper subvector.

50. The apparatus of claim 49, wherein the first and second de-quantization units multiply each codeword value of each lower subvector between the elements of the upper subvector by a value corresponding to the difference between the elements of the upper subvector and adds a value of a smaller element between the elements of the upper subvector to a result of the multiplication.

51. An apparatus to generate a codebook, the apparatus comprising:

a vector split unit to split a vector of a coefficient having order characteristics, which was converted from an LPC coefficient, into an upper subvector including anchor elements among elements that constitute the vector of the coefficient having the order characteristics and lower subvectors, each including elements respectively interposed between the elements of the upper subvector;

a vector classification unit to classify each of the lower subvectors by allocating an available bit to each of the lower subvectors using the upper subvector; and a codebook generation unit to generate a codebook by training the upper subvector and each of the classified subvectors, wherein a different available bit is allocated to subvectors in each of a plurality of codebooks for use in quantizing and dequantizing the lower subvectors, according to a distribution of elements of the subvectors.

52. The apparatus of claim 51, wherein the coefficient having the order characteristics is any one of an LSF, an LSP, ISFs, and an ISP coefficient.

53. The apparatus of claim 51, wherein the vector classification unit classifies each of the lower subvectors by allocating an available bit to each of the lower subvectors according to a ratio of intervals between elements of the upper subvector.

54. The apparatus of claim 51, wherein the vector classification unit classifies each of the lower subvectors by allocating an available bit to each of the lower subvectors according to an existence range of a predetermined element among the elements of the upper subvector.

55. The apparatus of claim 51, wherein the codebook generation unit trains the upper subvector and each of the classified subvectors using an LBG algorithm.

56. The apparatus of claim 51, wherein the codebook generation unit normalizes the codebook using the elements of the upper subvector.

57. The apparatus of claim 56, wherein the codebook generation unit normalizes the codebook by subtracting a value of whichever is smaller between the elements of the upper subvector from each codeword of each lower subvector between the elements of the upper subvector and then dividing the result of subtraction by a value corresponding to a difference between the elements of the upper subvector.

58. The apparatus of claim 51, wherein a maximum vector quantization dimension is set equal to or less than four when the coefficient is a tenth coefficient, and the maximum vector quantization dimension is set equal to or less than six when the coefficient is a sixth coefficient.

59. The apparatus of claim 51, wherein a number of the elements of the upper subvector are limited to be equal to or less than four when the coefficient is the tenth coefficient, and the number of the elements of the upper subvector are set equal to or less than six when the coefficient is the sixth coefficient.

60. The apparatus of claim 51, wherein the upper subvector is configured such that an intra-frame correlation between the elements of the upper subvector can be highest.

61. The apparatus of claim 51, wherein the upper subvector is configured such that the elements of the upper subvector are placed on both sides of each of the lower subvectors.

62. The apparatus of claim 51, wherein the upper subvector is configured such that the elements of the upper subvector are non-continuous.

63. An apparatus to convert an LPC coefficient into a predetermined coefficient and to quantize the coefficient, the apparatus comprising:

a vector split unit to split a vector of the predetermined coefficient into subvectors;

a codebook storage unit to store a plurality of codebooks in which an available bit is allocated to each of the subvectors according to a distribution of elements of each of the subvectors;

a codebook selection unit to select a codebook from the codebooks stored in the codebook storage unit according to the distribution of the elements of each of the subvectors; and a quantization unit to quantize each of the subvectors using the selected codebook and to generate a codebook index of each of the subvectors, wherein a different available bit is allocated to subvectors in each of a plurality of codebooks for use in quantizing lower subvectors, according to a distribution of elements of the subvectors.

64. The apparatus of claim 63, wherein the predetermined coefficient is an LSF coefficient.

65. An apparatus to generate a codebook, the apparatus comprising:

a vector split unit to split a vector of a predetermined coefficient into an upper subvector and plural lower subvectors, each subvector comprised of elements;

a vector classification unit to classify each of the lower subvectors using the elements of the upper subvector; and a codebook generation unit to generate a codebook by training the upper subvector and each of the classified subvectors using an LGB algorithm, wherein a different available bit is allocated to subvectors in each of a plurality of codebooks for use in quantizing lower subvectors, according to a distribution of elements of the subvectors.

66. A method of converting an LPC coefficient into a coefficient having order characteristics and quantizing the coefficient, the method comprising:

splitting a vector of the coefficient having the order characteristics into an upper subvector and lower subvectors;

quantizing, performed by using at least one processor, the upper subvector;

selecting a codebook among a plurality of codebooks in which an available bit is allocated to each of the lower subvectors according to distribution of elements of the quantized upper subvector;

normalizing elements of the lower subvectors; and quantizing each of the lower subvectors using the selected codebook and generating a codebook index of each of the lower subvectors, wherein the codebook is normalized and a different available bit is allocated to subvectors in each of the plurality of codebooks for use in quantizing the lower subvectors, according to a distribution of elements of the subvectors.

67. A method of de-quantizing an LPC coefficient into an LSF using a codebook index generated after an encoder converts the LPC coefficient into a vector of a coefficient having order characteristics, splits the vector of the coefficient into an upper subvector and lower subvectors, and quantizes the upper and lower subvectors, the method comprising:

de-quantizing, performed by using at least one processor, the upper subvector using a codebook index of the upper subvector;

selecting a normalized and pre-stored codebook among a plurality of normalized and pre-stored codebooks using elements of the de-quantized upper subvector;

de-quantizing each of the lower subvectors using a codebook index of each of the lower subvectors included in the selected codebook;

de-normalizing each of the de-quantized lower subvectors; and generating an LSF vector using the de-quantized upper subvector and the de-normalized lower subvectors, wherein a different available bit is allocated to subvectors in each of the plurality of normalized and pre-stored codebooks for use in de-quantizing the lower subvectors, according to a distribution of elements of the subvectors.

68. An apparatus for converting an LPC coefficient into a coefficient having order characteristics and quantizing the coefficient, the apparatus comprising:

a vector split unit splitting a vector of the coefficient having the order characteristics into an upper subvector and lower subvectors;

a first quantization unit quantizing the upper subvector;

a codebook storage unit storing a plurality of codebooks in which an available bit is allocated to each of the lower subvectors according to distribution of elements of the quantized upper subvector;

a codebook selection unit selecting a codebook from the plurality of codebooks stored in the codebook storage unit according to the distribution of the elements of the upper subvector;

a normalization unit normalizing elements of the lower subvectors; and a second quantization unit quantizing each of the lower subvectors using the selected codebook and generating a codebook index of each of the lower subvectors, wherein the codebooks are normalized and a different available bit is allocated to subvectors in each of the plurality of codebooks for use in quantizing the lower subvectors, according to a distribution of elements of the subvectors.

69. An apparatus for de-quantizing an LPC coefficient into an LSF using a codebook index generated after an encoder converts the LPC coefficient into a vector of a coefficient having order characteristics, splits the vector of the coefficient into an upper subvector and lower subvectors, and quantizes the upper and lower subvectors, the apparatus comprising:

a first de-quantization unit de-quantizing the upper subvector using a codebook index of the upper subvector;

a codebook storage unit storing a plurality of codebooks in which an available bit is allocated to each of the subvectors according to distribution of elements of each of the subvectors that constitute the vector of the coefficient having the order characteristics;

a codebook selection unit selecting a codebook from the plurality of codebooks stored in the codebook storage unit using elements of the de-quantized upper subvector;

a second de-quantization unit de-quantizing each of the lower subvectors using a codebook index of each of the lower subvectors included in the selected codebook;

a de-normalization unit de-normalizing each of the de-quantized lower subvectors; and a coefficient generation unit generating an LSF vector using the de-quantized upper subvector and the de-normalized lower subvectors, wherein the codebook is normalized and a different available bit is allocated to subvectors in each of the plurality of codebooks for use in quantizing the lower subvectors, according to a distribution of elements of the subvectors.

70. A non-transitory computer-readable recording medium on which a program for executing a method is recorded, the method comprising:

splitting a vector of a coefficient having order characteristics, which was converted from an LPC coefficient, into an upper subvector and lower subvectors;

quantizing the upper subvector;

selecting a normalized codebook among a plurality of normalized codebooks, in which an available bit is allocated to each of the lower subvectors according to distribution of elements of the quantized upper subvector;

normalizing elements of the lower subvectors; and quantizing each of the lower subvectors using the selected codebook and generating a codebook index of each of the lower subvectors, wherein a different available bit is allocated to the subvectors in each of the plurality of normalized codebooks, according to a distribution of elements of the subvectors.

71. A non-transitory computer-readable recording medium on which a program for executing a method is recorded, the method comprising:

de-quantizing an upper subvector using a codebook index of the upper subvector in a bitstream generated after an encoder converts an LPC coefficient into a vector of a coefficient having order characteristics, splits the vector of the coefficient into the upper subvector and lower subvectors, and quantizes the upper and lower subvectors;

selecting a normalized and pre-stored codebook among a plurality of normalized and pre-stored codebooks, using elements of the de-quantized upper subvector;

de-quantizing each of the lower subvectors using a codebook index of each of the lower subvectors included in the selected codebook;

de-normalizing each of the de-quantized lower subvectors; and generating an LSF vector using the de-quantized upper subvector and the de-normalized lower subvectors, wherein a different available bit is allocated to the subvectors in each of the plurality of normalized and pre-stored codebooks, according to a distribution of elements of the subvectors.

* * * * *